US009669516B2

(12) United States Patent
Lee et al.

(10) Patent No.: US 9,669,516 B2
(45) Date of Patent: Jun. 6, 2017

(54) APPARATUS AND METHOD FOR SURFACE TREATMENT OF OBJECTS

(71) Applicant: Samsung Electronics Co., Ltd., Gyeonggi-do (KR)

(72) Inventors: Sung-Choul Lee, Hwaseong-si (KR); Choul-Gue Park, Hwaseong-si (KR); Ki-Hong Jung, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 202 days.

(21) Appl. No.: 14/053,935

(22) Filed: Oct. 15, 2013

(65) Prior Publication Data

US 2014/0106650 A1 Apr. 17, 2014

(30) Foreign Application Priority Data

Oct. 15, 2012 (KR) ..... 10-2012-0114118
Sep. 23, 2013 (KR) ..... 10-2013-0112340

(51) Int. Cl.
*B24B 53/017* (2012.01)
*B24C 3/32* (2006.01)
(Continued)

(52) U.S. Cl.
CPC ..... *B24B 53/017* (2013.01); *B24C 1/083* (2013.01); *B24C 3/325* (2013.01); *B24C 3/327* (2013.01); *B24C 5/04* (2013.01)

(58) Field of Classification Search
CPC B24C 3/325; B24C 3/327; B24C 5/04; B24C 1/083
(Continued)

(56) References Cited

U.S. PATENT DOCUMENTS 7,241,206 B1 * 7/2007 Sung ..... B24B 7/228 451/527
8,561,927 B2 * 10/2013 Ko ..... B02C 19/06 241/1
(Continued)

FOREIGN PATENT DOCUMENTS

CN 1096471 12/1994
TW 437743 5/2001
(Continued)

OTHER PUBLICATIONS

Office Action for corresponding Chinese Patent Application No. 201310482141.7 dated Mar. 21, 2017, 7 pages.
(Continued)

*Primary Examiner* — Monica Carter
*Assistant Examiner* — Lauren Beronja
(74) *Attorney, Agent, or Firm* — Myers Bigel, P.A.

(57) ABSTRACT

An apparatus includes an injection part, a transfer part, a pressure supply part, a collision part and an emission part. An object is injected through the injection part. The transfer part is connected to the injection part, and bended at a plurality of points thereof. The object passes through the transfer part. The pressure supply part is connected to the transfer part and supplies a pressure into the transfer part to move the object. The collision part collides with the object moving in the transfer part to treat a surface of the object. The emission part is connected to the transfer part, and the object having the treated surface is emitted through the emission part.

14 Claims, 32 Drawing Sheets

(51) Int. Cl.
*B24C 5/04* (2006.01)
*B24C 1/08* (2006.01)

(58) Field of Classification Search
USPC ..... 451/35, 36, 38, 41, 54, 55, 56, 60, 61; 125/30.01
See application file for complete search history.

(56) References Cited

U.S. PATENT DOCUMENTS

| | | | | |
|---|---|---|---|---|
| 8,613,641 | B2 * | 12/2013 | Sasu et al. | 451/38 |
| 8,770,499 | B2 | 7/2014 | Kozawa et al. | |
| 2011/0048261 | A1 * | 3/2011 | Shimura | 101/395 |
| 2012/0179290 | A1 | 7/2012 | Lo | |

FOREIGN PATENT DOCUMENTS

| | | |
|---|---|---|
| TW | 201249539 | 12/2012 |
| WO | WO 2012/124452 | 9/2012 |

OTHER PUBLICATIONS

Office Action for corresponding Taiwanese Patent Application No. 102137049 dated Feb. 6, 2017, 8 pages.

* cited by examiner

APPARATUS AND METHOD FOR SURFACE TREATMENT OF OBJECTS

CROSS-REFERENCE TO RELATED APPLICATION

This application claims priority under 35 U.S.C. §119 to Korean Patent Application Nos. 10-2012-0114118 and 10-2013-0112340, filed on Oct. 15, 2012 and Sep. 23, 2013, respectively, in the Korean Intellectual Property Office (KIPO), the contents of which are herein incorporated by reference in their entireties.

BACKGROUND

A chemical mechanical polishing (CMP) process is performed by mechanically polishing a wafer using a polishing pad and simultaneously chemically polishing the wafer using slurries, and when the CMP process is repeatedly performed using the polishing pad, slurries and polishing byproducts may be deposited on the polishing pad so as to reduce the efficiency of polishing the wafer. Thus, a surface of the polishing pad may be conditioned by a pad conditioner so as to be kept clean and uniform.

The pad conditioner may include artificial diamonds on a plate, and when the pad conditioner is used in conditioning the polishing pad, the artificial diamonds may be crushed or separated from the pad conditioner to be attached to the polishing pad so that the wafer may be scratched during a CMP process using the polishing pad.

SUMMARY

Example embodiments provide an apparatus of surface treatment of an artificial diamond.

Example embodiments provide a method of treating a surface of an artificial diamond.

Example embodiments provide a method of manufacturing a pad conditioner using the same.

Example embodiments provide a CMP method using the same.

Example embodiments provide a method of manufacturing a semiconductor device using the same.

According to example embodiments, there is provided an apparatus of surface treatment. The apparatus includes an injection part, a transfer part, a pressure supply part, a collision part and an emission part. The transfer part includes a channel having first and second opposite end portions. The transfer part channel is bent at a plurality of points thereof. The injection part is at the first end portion of the transfer part channel and the emission part is at the second end portion of the transfer part channel. The injection part is configured to inject an object into the transfer part channel. The emission part is configured to emit the object from the injection part channel. The pressure supply part is connected to the transfer part channel and is configured to supply pressure into the transfer part channel to move the object toward the emission part. At least some of the bent points of the transfer part channel are exposed to the collision part such that the object moving in the transfer part channel collides with the collision part to treat a surface of the object.

In example embodiments, the transfer part may be a substrate with the channel disposed therein. The collision part may be detachably mounted on the substrate.

In example embodiments, the collision part may be exposed by the transfer part at some of the plurality of points of the transfer part to collide with the object moving in the transfer part.

In example embodiments, the collision part may be exposed by the transfer part at odd numbered ones of the plurality of points of the transfer part to collide with the object moving in the transfer part.

In example embodiments, the transfer part may have a diameter at odd numbered ones of the plurality of points thereof larger than a diameter at even numbered ones of the plurality of points thereof.

In example embodiments, the collision part may include a first target exposed by the transfer part at odd numbered ones of the plurality of points of the transfer part to collide with the object moving in the transfer part, and a second target exposed by the transfer part at even numbered ones of the plurality of points of the transfer part to collide with the object moving in the transfer part.

In example embodiments, the pressure supply part may supply a pressure by spraying gas or liquid into the transfer part.

In example embodiments, the gas may include air, and the liquid may include water.

In example embodiments, a plurality of pressure supply parts may be formed in the apparatus.

In example embodiments, the object may be an artificial diamond.

According to other example embodiments, an apparatus for surface treatment of objects includes a body, an injection member, an emission member, a pressure supply member and a collision member. The body has a transfer passageway having first and second opposite ends, and the transfer passageway is bent at a plurality of spaced-apart bent portions of the transfer passageway. The injection member is at the first end of the transfer passageway, and the injection member is configured to inject an object into the transfer passageway. The emission member is at the second end of the transfer passageway, and the emission member is configured to emit the object from the transfer passageway. The pressure supply member is connected to the transfer passageway near the injection member and is configured to supply pressure to the transfer passageway. The collision member on the body, and at least some of the bent portions of the transfer passageway are exposed to the collision member. The apparatus is configured such that an object injected by the injection member is conveyed along the transfer passageway by pressure supplied by the pressure supply member such that the object collides with the collision member at the bent portions of the transfer passageway that are exposed to the collision member before the object is emitted by the emission member.

According to example embodiments, there is provided a method for surface treatment of objects. The method includes providing an apparatus including: an injection part; an emission part; a transfer part having a transfer channel extending between the injection part and the emission part, wherein the transfer channel is bent at a plurality of spaced-apart bent portions of the transfer channel; a collision part on the transfer part, wherein at least some of the bent portions of the transfer channel are exposed to the collision member; and a pressure supply part connected to the transfer channel. The method includes injecting an object into the transfer channel via the injection part; supplying pressure into the transfer channel via the pressure supply part; conveying the object through the transfer channel using the supplied pressure such that the object collides with the collision part at the bent portions of the transfer channel that are exposed to the collision member to treat the object's surface; and emitting the object with the treated surface via the emission part.

According to example embodiments, there is provided a method of surface treatment. In the method, an object is injected into a transfer part via an injection part. A pressure is supplied into the transfer part via a pressure supply part to move the object in the transfer part. The object collides with a collision part a plurality of times along inclined directions to a surface of the collision part to treat a surface of the object. The object of which a surface has been treated is emitted via an emission part connected to the transfer part.

According to example embodiments, there is provided a method of manufacturing a pad conditioner. In the method, an artificial diamond is injected into a transfer part via an injection part. The transfer part is bended at a plurality of points thereof. A pressure is supplied into the transfer part via a pressure supply part to move the artificial diamond in the transfer part. The artificial diamond moving in the transfer part collides with a collision part a plurality of times to treat a surface of the artificial diamond. The artificial diamond of which a surface has been treated is emitted via an emission part connected to the transfer part. The emitted artificial diamond is mounted onto a plate. An adhesion layer is formed on the plate to partially cover the mounted artificial diamond so that the mounted artificial diamond is attached to the plate.

According to example embodiments, there is provided a method of CMP. In the method, an object layer is formed on a substrate. A pad conditioner is manufactured by following steps: an artificial diamond is injected into a transfer part bended at a plurality of points thereof via an injection part; a pressure is supplied into the transfer part via a pressure supply part to move the artificial diamond in the transfer part; the artificial diamond moving in the transfer part collides with a collision part a plurality of times to treat a surface of the artificial diamond; the artificial diamond of which a surface has been treated is emitted via an emission part connected to the transfer part; the emitted artificial diamond is mounted onto a plate; and an adhesion layer is formed on the plate to partially cover the mounted artificial diamond so that the mounted artificial diamond is attached to the plate. A polishing pad is conditioned with the pad conditioner. The object layer is polished using the conditioned polishing pad and slurry.

According to example embodiments, there is provided a method of manufacturing a semiconductor device. In the method, i) an object layer is formed on a substrate. II) a pad conditioner is manufactured by following steps: an artificial diamond is injected into a transfer part bended at a plurality of points thereof via an injection part; a pressure is supplied into the transfer part via a pressure supply part to move the artificial diamond in the transfer part; the artificial diamond moving in the transfer part collides with a collision part a plurality of times to treat a surface of the artificial diamond; the artificial diamond of which a surface has been treated is emitted via an emission part connected to the transfer part; the emitted artificial diamond is mounted onto a plate; and an adhesion layer is formed on the plate to partially cover the mounted artificial diamond so that the mounted artificial diamond is attached to the plate. III) A polishing pad is conditioned with the pad conditioner. IV) The object layer is polished using the conditioned polishing pad and slurry. Each of the steps I), III) and IV) is performed at least one time.

According to example embodiments, an object, e.g., an artificial diamond may be collided with a collision part of an apparatus of surface treatment a plurality of times so that a rough surface of the artificial diamond may be smoothened and a polycrystalline artificial diamond may be divided into single crystalline artificial diamonds. Thus, when a polishing pad is conditioned with a pad conditioner of a CMP apparatus including the artificial diamond of which a surface has been treated, the artificial diamond may not be detached from the pad conditioner to stick to the polishing pad, and thus scratches may not be generated on a wafer during a CMP process for the wafer using the CMP apparatus.

BRIEF DESCRIPTION OF THE DRAWINGS

Example embodiments will be more clearly understood from the following detailed description taken in conjunction with the accompanying drawings.

FIG. 1 is a perspective view illustrating an apparatus of surface treatment in accordance with example embodiments;

FIG. 2 is a cross-sectional view illustrating a transfer part of the apparatus of surface treatment of FIG. 1 in accordance with some example embodiments;

FIG. 3 is a cross-sectional view illustrating an apparatus of surface treatment in accordance with other example embodiments;

FIG. 4 is a drawing showing the movement of an object in the transfer part of the apparatus of surface treatment of FIGS. 1 and 2 and the collision of the object with a collision part thereof;

FIGS. 5 and 6 are cross-sectional views illustrating an apparatus of surface treatment in other example embodiments;

FIG. 7 is a flowchart illustrating a method of treating a surface of an object using an apparatus of surface treatment in accordance with example embodiments;

FIGS. 8 to 10 are cross-sectional views illustrating a method of manufacturing a pad conditioner in accordance with example embodiments;

FIG. 11 is a plan view of the pad conditioner manufactured by the method of FIGS. 8 to 10;

FIG. 12 is a perspective view illustrating a CMP apparatus for performing a CMP method;

FIG. 13 is a flowchart illustrating a CMP method using the CMP apparatus of FIG. 12;

FIG. 14 is a flowchart illustrating a method of manufacturing a semiconductor device by polishing an object layer using a CMP apparatus including a pad conditioner, which may include artificial diamonds manufactured by a method of surface treatment in accordance with example embodiments;

FIGS. 15 to 31 illustrate stages of a method of manufacturing a semiconductor device in accordance with example embodiments. FIGS. 15, 17, 19, 21, 23, 25 and 27 are plan views illustrating stages of a method of manufacturing a semiconductor device in accordance with example embodiments, and FIGS. 16, 18, 20, 22, 24, 26 and 28 to 31 are cross-sectional views illustrating stages of a method of manufacturing the semiconductor device in accordance with example embodiments; and FIGS. 32 to 37 are cross-sectional views illustrating stages of a method of manufacturing a semiconductor device in accordance with example embodiments.

DESCRIPTION OF EMBODIMENTS

Figure 1:
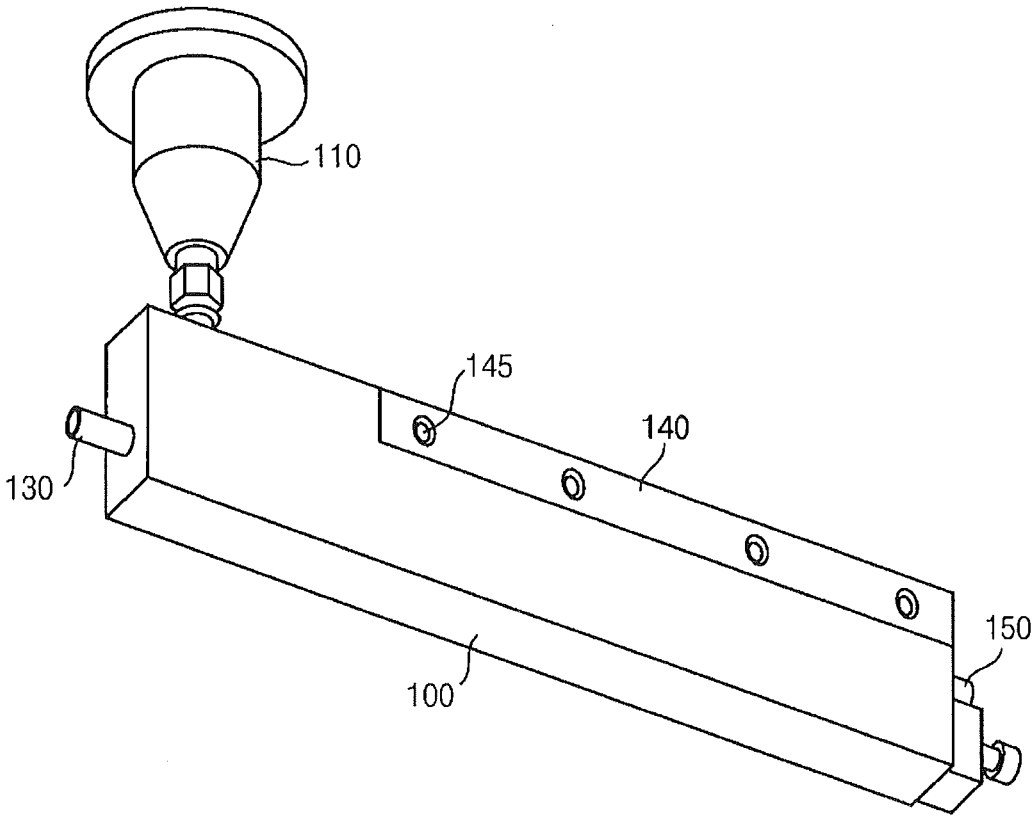
FIGS. 1 to 37 represent non-limiting, example embodiments as described herein.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this description will be thorough and complete, and will fully convey the scope of the present inventive concept to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, fourth etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present inventive concept.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to illustrations (e.g., cross-sectional illustrations) that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, unless otherwise indicated, the regions illustrated in the figures are schematic in nature and their shapes are not intended to illustrate the actual shape of a region of a device and are not intended to limit the scope of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
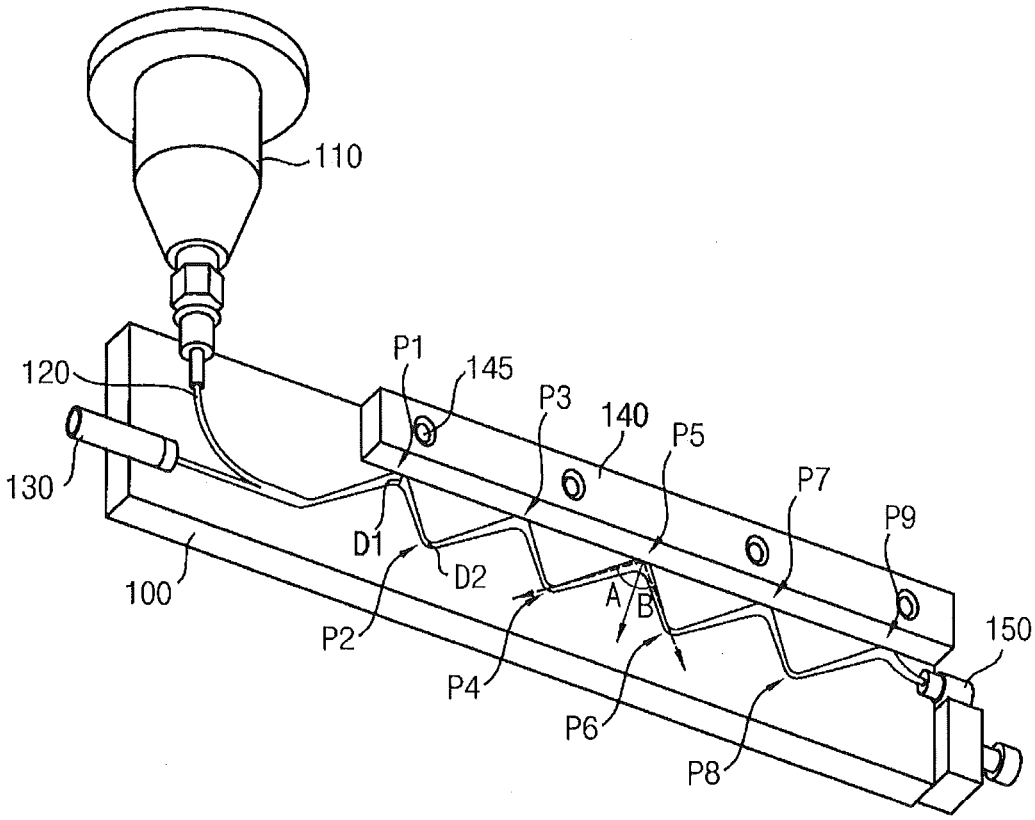
Figure 3:
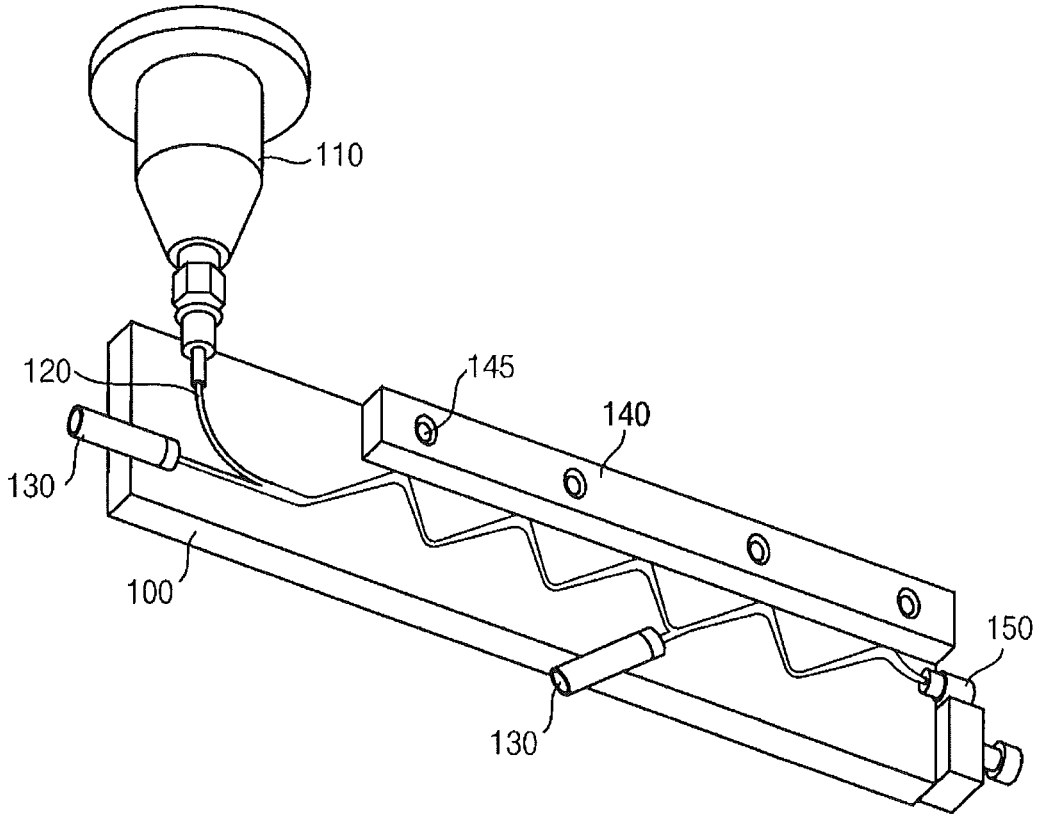
Figure 4:
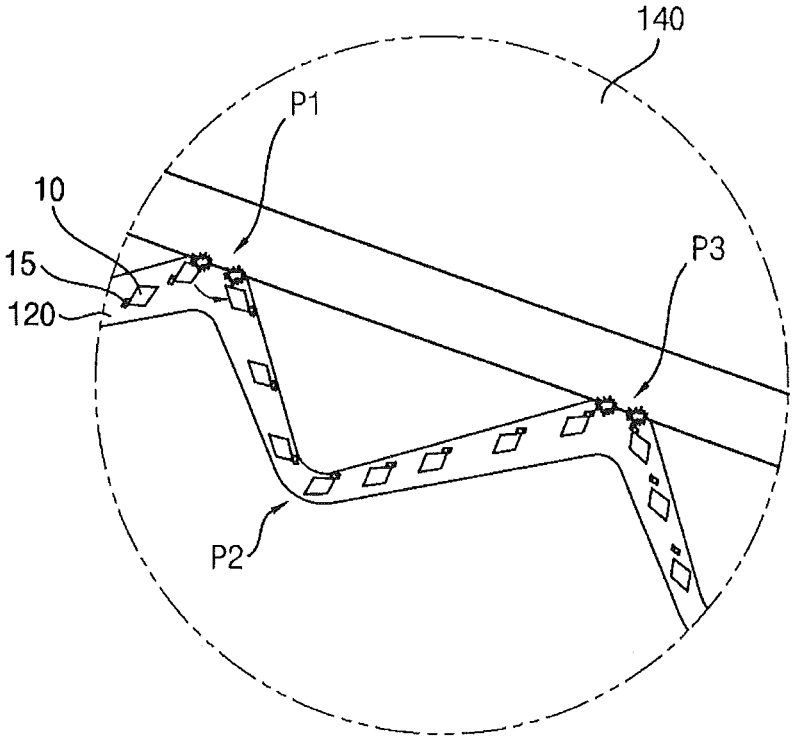

FIG. 1 is a perspective view illustrating an apparatus of surface treatment in accordance with example embodiments, FIG. 2 is a cross-sectional view illustrating a transfer part of the apparatus of surface treatment, FIG. 3 is a cross-sectional view illustrating an apparatus of surface treatment in accordance with other example embodiments, and FIG. 4 is a drawing showing the movement of an object in the transfer part of the apparatus of surface treatment of FIGS. 1 and 2 and the collision of the object with a collision part thereof. For the convenience of explanations, FIGS. 2 and 3 show cross-sectional views of a substrate in which the transfer part is formed, and other parts of the apparatus of surface treatment are shown in a perspective view as FIG. 1.

Referring to FIGS. 1 and 2, the apparatus of surface treatment may treat a surface of an object by collision, and may include an injection device, member or part 110, a transfer device, member or part 120, a pressure supply device, member or part 130, a collision device, member or part 140 and an emission device, member or part 150.

The object may include a surface of which a shape may be irregular or rough, or may include a surface having a tip or defect thereon. Alternatively, the object may have a polycrystalline structure. Thus, the surface of the object may be treated by the apparatus of surface treatment so that the surface of the object may have a regular or smooth shape or the tip or defect may be removed from the object. Alternatively, the object may be divided into a plurality of pieces each of which may have a single crystalline structure.

In example embodiments, the object may be an artificial diamond used for a pad conditioner that may condition a polishing pad of a chemical mechanical polishing (CMP) apparatus.

The injection part 110 may be a part of the apparatus of surface treatment into which the object may be injected. In example embodiments, the injection part 110 may have a funnel shape of which an entrance may have a relatively large diameter and an exit may have a relatively small diameter. In an example embodiment, the diameter of the exit of the injection part 110 may be about 1 to about 2 times a diameter of the object. Thus, even though many objects can be simultaneously injected into the injection part 110, only one of the objects may be injected into the transfer part 120 connected to the exit of the injection part 110.

An end of the transfer part 120 may be connected to the exit of the injection part 110, and the transfer part 120 may extend from the exit of the injection part 110 so as to serve as a path for the movement of the object injected into the injection part 110. In example embodiments, the transfer part 120 may extend to be bent at a plurality of points thereof (e.g., bend or transition points of the transfer part 120 where the transfer part 120 changes direction).

In example embodiments, the transfer part 120 may be a channel, passageway or hole in a body, housing or substrate 100. The substrate 100 may include, e.g., a metal such as stainless steel. Alternatively, the transfer part 120 may be a tubular component such as a pipe including a metal. Hereinafter, only the case in which the transfer part 120 has a hole shape may be illustrated for the convenience of explanations.

The pressure supply part 130 may be connected to the transfer part 120 to supply a pressure thereinto so that the object injected into the transfer part 120 may move therein. Thus, the pressure supply part 130 may be disposed at a portion of the transfer part 120 adjacent to the exit of the injection part 110.

Alternatively, a plurality of pressure supply parts 130 may be disposed to be connected to a plurality of points of the transfer part 120, and an apparatus of surface treatment including the plurality of pressure supply parts 130 is shown in FIG. 3. When the apparatus of surface treatment includes the plurality of pressure supply parts 130, a pressure applied to the object moving in the transfer part 120 may be controlled.

The pressure supply part 130 may supply a pressure by spraying gas, e.g., air, or liquid, e.g., water.

The collision part 140 may collide with the object moving in the transfer part 120 a plurality of times to treat a surface of the object. That is, when the object includes a surface having an irregular or rough shape, or having a tip or defect thereon, the object may collide with the collision part 140 a plurality of times so that the surface of the object may be treated. Thus, the object may have a regular or smooth shape, or the tip or defect may be removed from the object. Alternatively, when the object has a polycrystalline structure, the object may be divided into several pieces so that each object may have a single crystalline structure. The collision part 140 may include, e.g., a metal such as stainless steel.

In example embodiments, the collision part 140 may be exposed by the transfer part 120 at some of the plurality of points (e.g., bend or transition points) of the transfer part 120 at which the transfer part 120 is bent to collide with the object. For example, the transfer part 120 may be bent at first to ninth points P1-P9, and the collision part 140 may be exposed by the transfer part 120 at odd numbered points P1, P3, P5, P7 and P9 to collide with the object (e.g., collision points or portions). As illustrated, five portions of the collision part 140 may collide with the object, although a greater or lesser number of such portions are contemplated.

In example embodiments, a first diameter D1 of the odd numbered bending portions P1, P3, P5, P7 and P9 of the transfer part 120 may be larger than a second diameter D2 of the even numbered bending portions P2, P4, P6 and P8 of the transfer part 120. For example, the first diameter D1 may be about 1.5 to about 3 times the diameter of the object, and the second diameter D2 may be about 1 to about 1.5 times the diameter of the object.

In example embodiments, a first angle A of a portion of the transfer part 120 extending from the even numbered points P2, P4, P6 and P8 to the odd numbered points P1, P3, P5, P7 and P9 along a direction in which the object may move with respect to a normal line of a surface of the collision part 140 may be larger than a second angle B of a portion of the transfer part 120 extending from the odd numbered points P1, P3, P5, P7 and P9 to the even numbered points P2, P4, P6 and P8 along the direction in which the object may move with respect to the normal line of the surface of the collision part 140.

Thus, referring to FIGS. 2 and 4, a process for removing a tip 15 from a surface of the object, e.g., an artificial diamond 10 by collisions between the artificial diamond 10 and the collision part 140 may be illustrated as follows, The artificial diamond 10 may move in the transfer part 120 and collide with a surface of the collision part 140 at a first point P1. At this point P1, the artificial diamond 10 may change a direction thereof. Thus, the tip 15 on a rear surface of the artificial diamond 10 along a movement direction may change its location to a front surface of the artificial diamond 10 along the movement direction. The transfer part 120 may have the first diameter D1 relatively large, and thus the artificial diamond 10 may change its direction more easily.

The artificial diamond 10 may move toward a second point P2 of the transfer part 120. The second angle B is smaller than the first angle A, and thus the artificial layer 10 may move along or attached onto a sidewall of the transfer part 120 or alternately collide with opposing sidewalls of the transfer part 120. When the artificial diamond 10 passes through the second point P2, the transfer part 120 may have the second diameter D2 relatively small, and thus the artificial diamond 10 may not change its direction.

When the artificial diamond 10 passes through a third point P3, the tip 15 on the front surface of the artificial diamond 10 may collide with a surface the collision part 140, and the artificial diamond 10 may change its direction as at the first point P 1. That is, a surface the artificial diamond 10 colliding with the collision part 140 may be changed when the artificial diamond 10 passes through the first, third, fifth, seventh and ninth points P1, P3, P5, P7 and P9, and thus the whole surface of the artificial diamond 10 may be treated. FIG. 4 shows that the tip 15 may be removed from the artificial diamond 10 due to the impulse at the first and third points P1 and P3 when the artificial diamond 10 passes through the third point P3.

The collision part 140 may be detachably or releasably mounted onto the substrate 100. For example, the collision part 140 may be detachably mounted onto the substrate 100 by one or more fixing members or parts 145, e.g., bolts and nuts. Thus, when the collision part 140 collides with objects more than a given number of times, the collision part 140 may be replaced with a new one, so that the function of the collision part 140, i.e., treating surfaces of objects, may be kept.

The emission part 150 may be connected to another end of the transfer part 120 to emit the object of which a surface has been treated. In an example embodiment, a detection or measurement device or unit such as or including a spectroscope may be installed at the emission part 150 to detect or measure the surface and/or the crystalline state of the object, and may collect or divert the object separately if the surface of the object has not been sufficiently treated and transfer it to the injection part 110 again.

Figure 5:
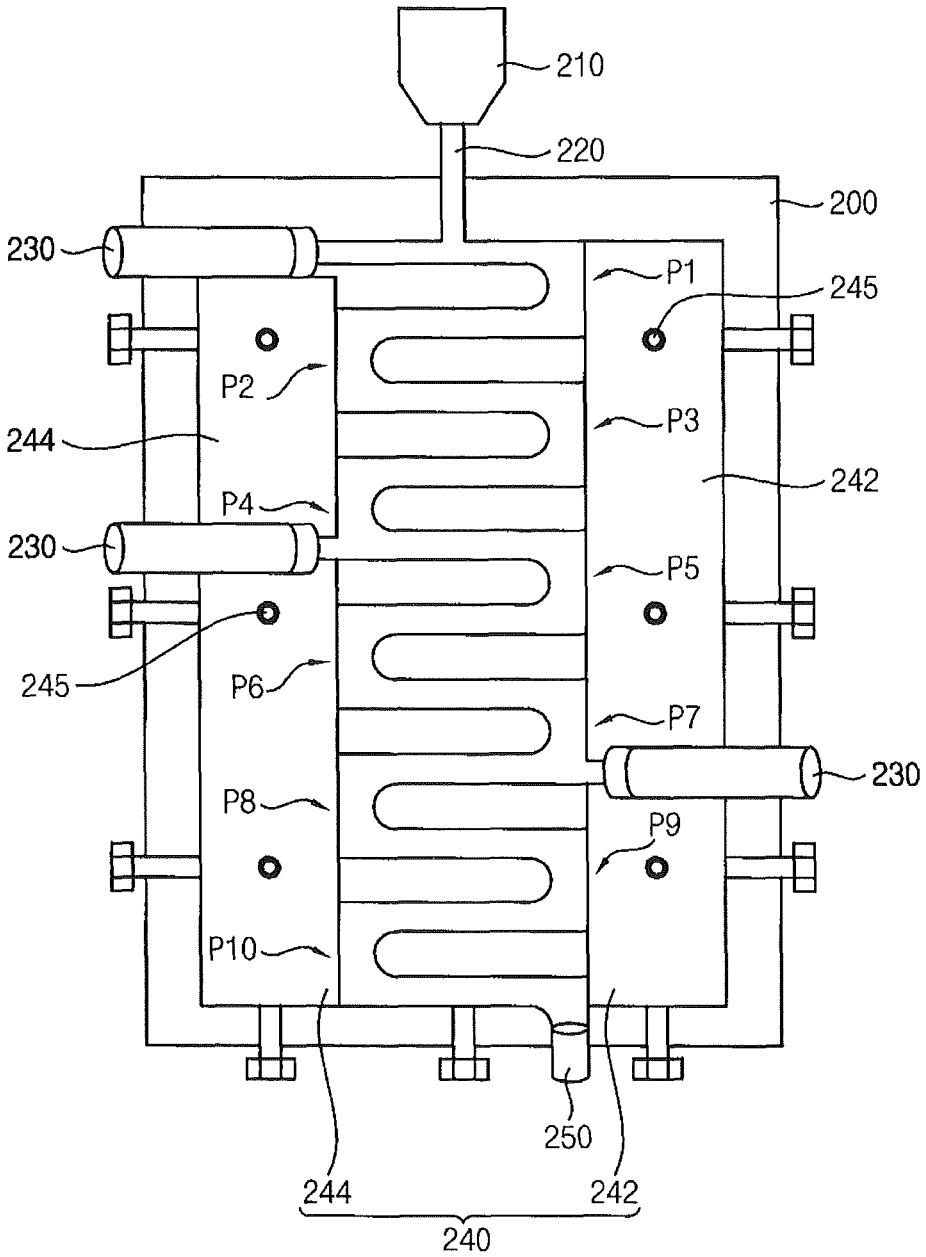
Figure 6:
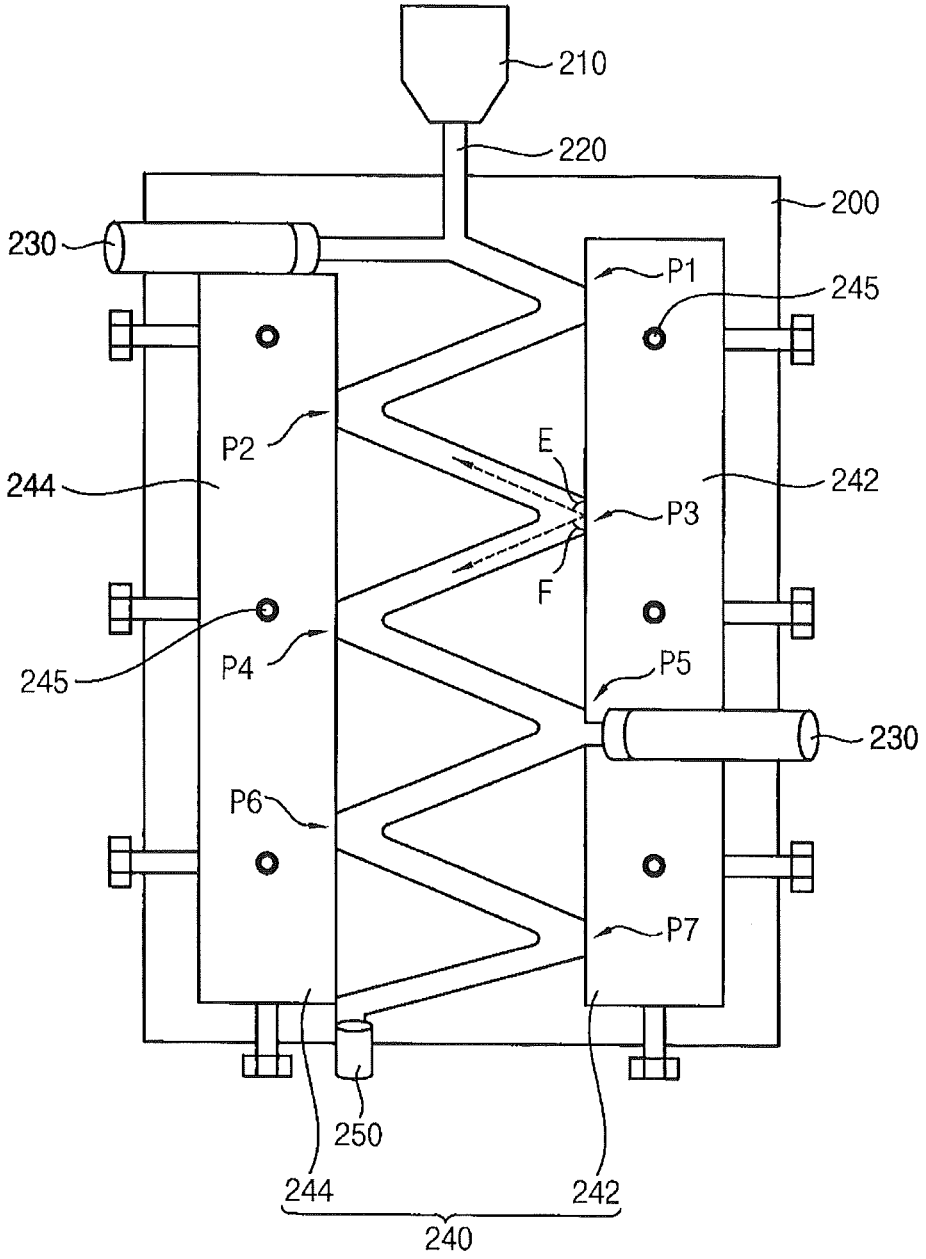

FIGS. 5 and 6 are cross-sectional views illustrating an apparatus of surface treatment in other example embodiments. The apparatuses of surface treatment may be substantially the same as or similar to those illustrated with reference to FIGS. 1 to 3 except for the transfer part and the collision part. Thus, detailed descriptions on the same or similar elements may be omitted herein.

Referring to FIGS. 5 and 6, the apparatus of surface treatment may include an injection device, member or part 210, a transfer device, member or part 220, a pressure supply device, member or part 230, a collision device, member or part 240 and an emission device, member or part 250.

An end of the transfer part 220 may be connected to an exit of the injection part 210, and the transfer part 220 may extend from the exit of the injection part 210 so that another end of the transfer part 220 may be connected to the emission part 250. In example embodiments, the transfer part 220 may extend to be bent at a plurality of points thereof.

In an example embodiment, the transfer part 220 may include a plurality of first extension portions extending in a horizontal direction and a plurality of first bending portions connecting the plurality of first extension portions to each other, which are shown in FIG. 5. That is, the first extension portions may be connected to each other at first to tenth points P1-P10 of the transfer part 220 by the first bending portions. The numbers of the first extension portions and the first bending portions may not be limited to those illustrated, and e.g., the transfer part 220 may include at least 30 first bending portions.

In other example embodiments, the transfer part 220 may include a plurality of second extension portions extending in an inclined direction, which is neither a horizontal direction nor a vertical direction, and a plurality of second bending portions connecting the plurality of second extension portions to each other, which are shown in FIG. 6. That is, the second extension portions may be connected to each other at first to seventh points P1-P7 of the transfer part 220 by the second bending portions. The numbers of the second extension portions and the second bending portions may not be limited to those illustrated.

In example embodiments, the transfer part 220 may be a channel, passageway or hole in a body, housing or substrate 200. Alternatively, the transfer part 220 may be a tubular member such as a pipe including a metal. Hereinafter, only the case in which the transfer part 220 has a hole shape may be illustrated for the convenience of explanations.

The pressure supply part 230 may be connected to the transfer part 220, and supply a pressure thereinto so that an object injected into the transfer part 220 may move therein. Thus, the pressure supply part 230 may be disposed at a portion of the transfer part 220 adjacent to the exit of the injection part 210. Alternatively, a plurality of pressure supply parts 230 may be disposed to be connected to a plurality of points of the transfer part 220. In FIGS. 5 and 6, the apparatuses of surface treatment including the plurality of pressure supply parts 230 are shown.

The collision part 240 may collide with the object moving in the transfer part 220 a plurality of times to treat a surface of the object.

In example embodiments, the collision part 240 may include first and second members, portions or targets 242 and 244 opposing to each other on the substrate 200. The first target 242 may be exposed by or to the transfer part 220 at odd numbered points P1, P3, P5, P7 and P9 of the transfer part 220 among the plurality of points P1-P10 at which the plurality of bending portions are located to collide with the object. The second target 244 may be exposed by or to the transfer part 220 at even numbered points P2, P4, P6, P8 and P10 of the transfer part 220 among the plurality of points P1-P10 at which the plurality of bending portions are located to collide with the object.

In FIG. 6, a third angle E of the second extension portions of the transfer part 220 extending from the even numbered points P2, P4 and P6 to the odd numbered points P1, P3, P5 and P7 along a direction in which the object may move with respect to a surface of the collision part 240 may be substantially the same as or different from a fourth angle F of the second extension portions of the transfer part 220 extending from the odd numbered points P1, P3, P5 and P7 to the even numbered points P2, P4 and P6 along the direction in which the object may move with respect to the surface of the collision part 240.

The first and second targets 242 and 244 may include, e.g., a metal such as stainless steel, and each of the targets 242 and 244 may be detachably or releasably mounted on the substrate 200. That is, for example, the collision part 240 may be detachably mounted onto the substrate 200 by one or more fixing members or parts 245, e.g., bolts and nuts.

The apparatuses of FIGS. 5 and 6 may include the collision part 240 composed of the opposing first and second targets 242 and 244 unlike the apparatuses of FIGS. 1 to 3, and thus the number of collision of the object to the collision part 240 may be increased.

Figure 7:
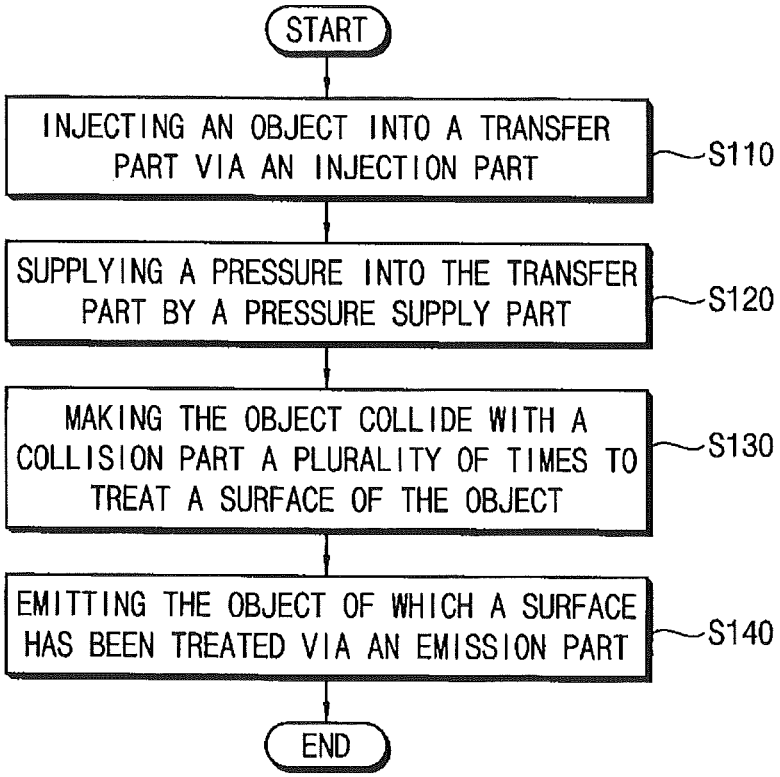

FIG. 7 is a flowchart illustrating a method of treating a surface of an object using an apparatus of surface treatment in accordance with example embodiments. Hereinafter, only the case in which the surface of the object may be treated with the apparatus of FIGS. 1 and 2 will be described for the convenience of explanation.

Referring to FIG. 7, in step S110, an object of which a surface may be treated may be injected via the injection part 110 into the transfer part 120 that may extend to be bent at the plurality of points P1-P9.

In step S120, the pressure supply part 130 connected to the transfer part 120 may supply a pressure into the transfer part 120 so that the object may move in the transfer part 120.

In step S130, the object moving in the transfer part 120 may collide with the collision part 140 at a plurality of times so that the surface of the object may be treated.

In example embodiments, the transfer part 120 may extend to be bended at the plurality of points P1-P9, and the object may collide with the collision part 140 at least at some of the points P1-P9, so that the object may collide with the collision part 140 at a plurality of times along inclined directions relative to a surface of the collision part 140.

In step S140, the object of which a surface has been treated may be emitted via the emission part 150 connected to the transfer part 120.

The object emitted by the above steps may have a regular or smooth surface, a tip may be removed from the object, or the object may be divided so that each object may have a single crystalline structure.

Figure 8:
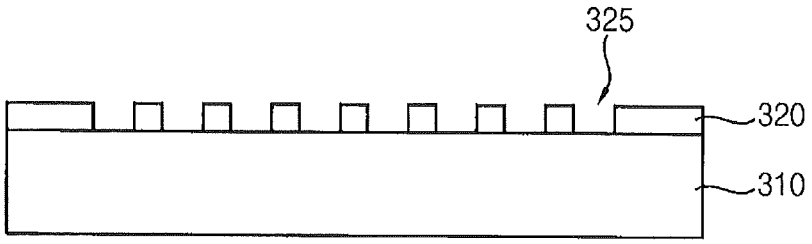
Figure 9:
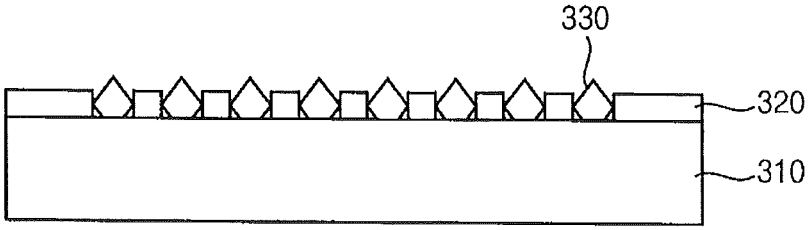
Figure 10:
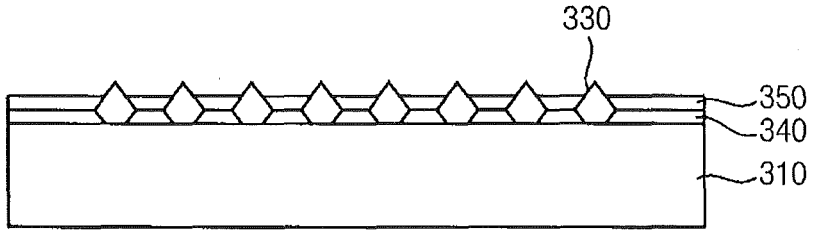
Figure 11:
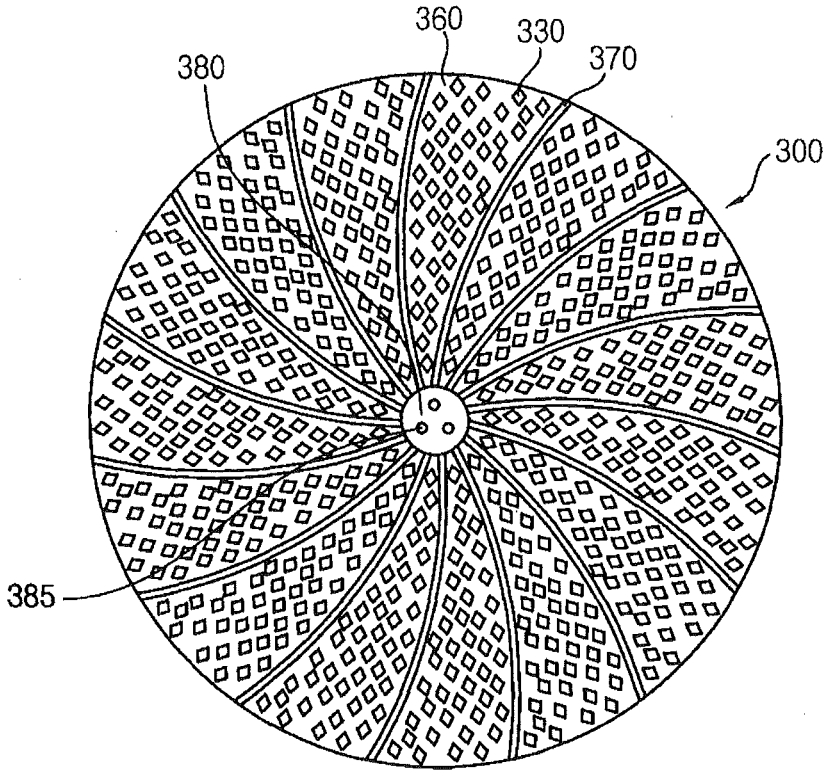

FIGS. 8 to 10 are cross-sectional views illustrating a method of manufacturing a pad conditioner in accordance with example embodiments, and FIG. 11 is a plan view of the pad conditioner manufactured by the above method.

Referring to FIG. 8, a mask 320 may be formed on a plate 310.

In example embodiments, the plate 310 may have a circular shape, and include a metal or plastic. The mask 320 may include a plurality of openings 325, and each opening 325 may expose a top surface of the plate 310. In an example embodiment, the mask 320 may be formed to include an insulating material.

Referring to FIG. 9, the method of treating a surface illustrated with reference to FIG. 7 may be performed using the apparatus of surface treatment illustrated with reference to FIGS. 1 to 6 to produce a plurality of artificial diamonds 330, which may be mounted on the exposed top surfaces of the plate 310, respectively.

Referring to FIG. 10, after removing the mask 320, an adhesion layer 340 may be formed on the plate 310 so that the mounted artificial diamonds 330 may be attached onto the plate 310.

The adhesion layer 340 may be formed to partially cover each artificial diamond 330. The adhesion layer 340 may be formed by an electroplating using, e.g., a metal such as palladium, cobalt, nickel, etc.

A protection layer 350 may be formed on the adhesion layer 340 to partially cover each artificial diamond 330 so that the pad conditioner may be manufactured.

The pad conditioner manufactured by the above method may include the artificial diamonds 330 having a regular or smooth surface, having no tips, or having a single crystalline structure, and thus a polishing pad may be easily conditioned by the pad conditioner.

Referring now to FIGS. 10 and 11, a pad conditioner 300 may include a plate 310 having a conditioning area 360, a flow path area 370 and a holding area 380, and a holder for holding the plate 310.

The plurality of artificial diamonds 330 of which surfaces have been treated may be disposed in the conditioning area 360, and polishing residues and/or slurry residues may be removed from a polishing pad used in a CMP process by the artificial diamonds 330. In example embodiments, the plate 310 may have a plurality of conditioning areas 360 that may be disposed in a tornado shape.

The flow path area 370 may serve as a passage through which slurries remaining on the polishing pad may move, and thus the artificial diamonds 330 may not be disposed therein. In example embodiments, the plate 310 may have a plurality of flow path areas 370, and the conditioning areas 360 may be divided by the plurality of flow path areas 370, In example embodiments, the holding area 380 may be disposed at a central portion of the plate 310. For example, one or more fixing grooves or openings 385 may be formed in the holding area 380, and the plate 310 may be fixed to the holder by the fixing groove(s) 385.

Figure 12:
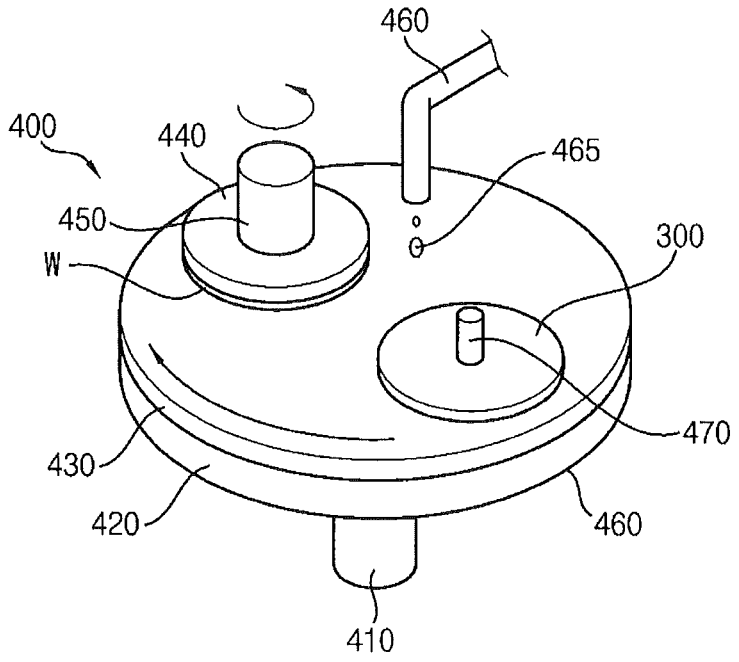
Figure 13:
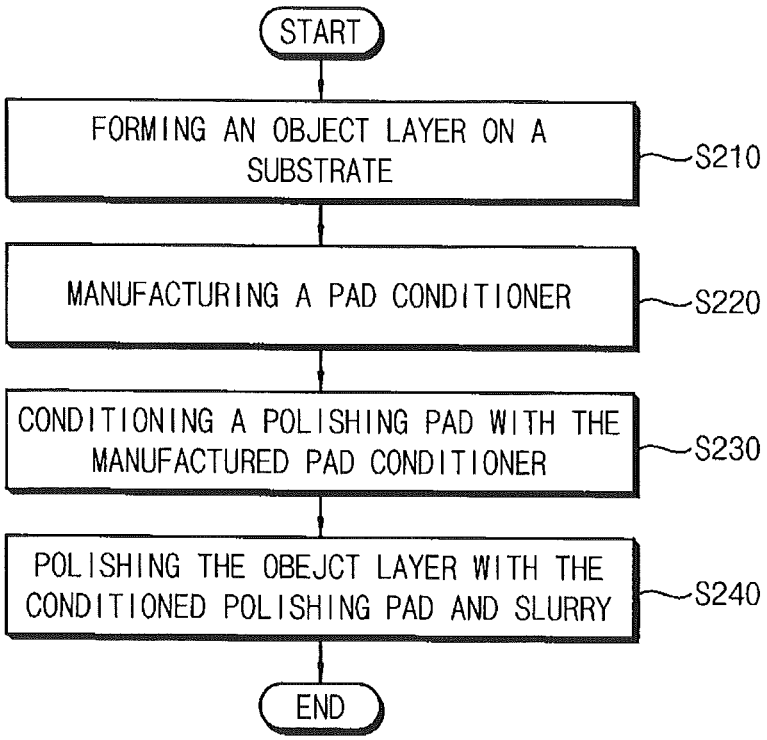

FIG. 12 is a perspective view illustrating a CMP apparatus for performing a CMP method, and FIG. 13 is a flowchart illustrating a CMP method using the CMP apparatus of FIG. 12.

Referring to FIG. 12, a CMP apparatus 400 may include a driver or driving axis 410, a platen or platter 420, a polishing pad 430, a polishing head 440, a first driving member 450, a slurry supply device, member or part 460, a pad conditioner 300 and a second driving member 470.

The driver or driving axis 410 may be disposed beneath the platen 420 to rotate the platen 420, and thus the polishing pad 430 mounted on the platen 420 may be also rotated.

In example embodiments, the platen 420 and the polishing pad 430 may have a disc shape. The polishing pad 430 may include grooves through which a slurry 465 supplied by the slurry supply part 460 may move and micropores that may contain the slurry 465 therein. The polishing pad 430 may be a hard pad or a soft pad, and may include, e.g., polyurethane.

The polishing head 440 may hold a substrate on which an object layer is formed, e.g., a wafer W therebeneath, and may move in a vertical direction by the first driving member 450 so that the wafer W may contact a top surface of the polishing pad 430. Thus, the polishing head 440 may apply a given pressure onto the wafer W or the polishing pad 430. While the wafer W contacts the polishing pad 430, the polishing head 440 may be rotated or moved linearly by the first driving member 450 so that the wafer W may be also rotated or moved linearly. The object layer may be mechanically polished by the rotation or linear motion of the wafer W, and chemically polished by the slurry 465 supplied by the slurry supply part 460.

The pad conditioner 300 manufactured by the method illustrated with reference to FIGS. 8 to 10 may be moved in a vertical direction by the second driving member 470 to contact a top surface of the polishing pad 430. Thus, the pad conditioner 300 may apply a given pressure onto the polishing pad 430. While the wafer W contacts the polishing pad 430, the pad conditioner 300 may be rotated or moved linearly by the second driving member 470 so that the polishing residues or slurry residues remaining on the polishing pad 430 may be removed, or a roughness of the polishing pad 430 may be enhanced.

Referring to FIGS. 12 and 13, the CMP method may be performed using the CMP apparatus by following steps.

In step S210, an object layer may be formed on a substrate, e.g., the wafer W. The object layer may include an insulating material or a conductive material.

In step S220, the pad conditioner 300 may be manufactured by the method illustrated with reference to FIGS. 8 to 10. Thus, the pad conditioner 300 including artificial diamonds having a regular or smooth surface, having no tips, or having a single crystalline structure may be manufactured.

In step S230, the polishing pad 430 may be conditioned by the pad conditioner 300.

That is, while the polishing pad 430 is rotated by rotating the platen 420 via the driving axis 410, the pad conditioner 300 may contact a top surface of the polishing pad 430 via the second driving member 470, and the pad conditioner 300 may be rotated or moved linearly, such that the pad conditioner 300 and the polishing pad 430 may be rubbed against each other. Thus, the polishing residues and/or the slurry residues remaining on the polishing pad 430 by repeatedly performing a CMP method may be removed, and a roughness of the polishing pad 430 may be enhanced.

Particularly, surfaces of the artificial diamonds in the pad conditioner 300 that may contact the top surface of the polishing pad 430 may be treated as above, and thus no tips or parts of the artificial diamonds may be present that may be detached from the artificial diamonds to stick to the polishing pad 430 by the rubbing.

In step S240, the wafer W on which the object layer is formed may be loaded to the polishing head 440 and mounted thereto. While the polishing pad 430 is rotated by rotating the platen 420 via the driving axis 410, the polishing head 440 may be moved in a vertical direction via the first driving member 450 to contact the wafer W to a top surface of the polishing pad 430, and the polishing head 440 may be rotated or moved linearly to rub the wafer W against the polishing pad 430. Additionally, the slurry 465 may be supplied onto the polishing pad 430 by the slurry supply part 460 to contact the object layer on the wafer W. Thus, the object layer may be polished by a mechanical rubbing with the polishing pad 430 and a chemical reaction with the slurry 465.

As described above, when the polishing pad 430 is conditioned by the pad conditioner 300 in step S230, the surfaces of the artificial diamonds in the pad conditioner 300 have been treated, and thus no or substantially no tips or part of the artificial diamonds may be detached from the artificial diamonds. Even if some tips or part of the artificial diamonds may be detached therefrom, surfaces of the tips or parts may be smooth so that the wafer W may not be damaged or scratched due to the artificial diamonds.

Meanwhile, the process for conditioning the polishing pad 430 with the pad conditioner 300 in step S230 may be performed simultaneously with or after the polishing process in step S240.

Comparative Experiment

In order to confirm the characteristics of the method of surface treatment using the apparatus of surface treatment in accordance with example embodiments, when a polishing pad is conditioned using the pad conditioner manufactured by the apparatus and method of surface treatment, a ratio of scratches on a wafer polished by the polishing pad was measured.

That is, when the polishing pad was conditioned using the pad conditioner manufactured with the artificial diamonds of which surfaces had been treated in accordance with Embodiments 1 and 2 and Comparative Examples 1 to 3, respectively, ratios of scratches on the wafer generated while being polished by the polishing pad were measured. Embodiment 1 used artificial diamonds of which surfaces had been treated using the apparatus of surface treatment of FIGS. 1 and 2, Embodiment 2 used artificial diamonds of which surfaces had been treated using the apparatus of surface treatment of FIG. 5, Comparative Example 1 used artificial diamonds of which surfaces had been treated by injecting the artificial diamonds together with a plurality of steel balls into a metal container and shaking the metal container to collide with each other, Comparative Example 2 used artificial diamonds of which surfaces had been treated by injecting the artificial diamonds together with a plurality of steel balls into a metal container and shaking the metal container to collide with each other, and later colliding each artificial diamond with a metal wall, and Comparative Example 3 used artificial diamonds of which surfaces had not been treated at all. Particularly, the artificial diamonds of Embodiment 1 collided with the collision part at 5 points, the artificial diamonds of Embodiment 2 collided with the collision part at 30 points, and the artificial diamonds of Comparative Examples 1 and 2 collided with the steel balls for about 40 minutes.

In order to measure ratios of scratches on a wafer, a polishing pad having no pores and a diameter of about 190 mm was mounted on a platen, the wafer was mounted on a polishing head, the polishing head applied a pressure of about 25 lbf onto the polishing pad, and the polishing pad and the polishing head were rotated. Additionally, a deionized water was supplied at a flow rate of about 150 cc/min onto the polishing pad to polish the wafer.

The pad conditioners in accordance with Embodiments 1 and 2 and Comparative Example 1 to 3 applied a pressure of about 33 lbf onto the polishing pad for about 60 seconds and were rotated to condition the polishing pad. The ratios of scratches generated on the wafer are listed in the following Table.

TABLE

| | Embodiment 1 | Embodiment 2 | Comparative example 1 | Comparative example 2 | Comparative example 3 |
|---|---|---|---|---|---|
| Scratch generation ratio | 0% | 0% | 15.6% | 3.1% | 34.1% |

Referring to Table, when the polishing pad was conditioned with the apparatuses of surface treatment in accordance with Embodiments 1 and 2, the scratch generation ratios were very low when compared to the apparatuses of surface treatment in accordance with Comparative Examples 1 to 3.

That is, the method of surface treatment using the apparatus of surface treatment in accordance with Embodiments 1 and 2 may have such a good effect that artificial diamonds having a smooth surface may be produced. Accordingly, when a polishing pad is conditioned using a pad conditioner manufactured with the above artificial diamonds, the wafer that may be polished by the polishing pad may not be scratched or damaged.

Figure 14:
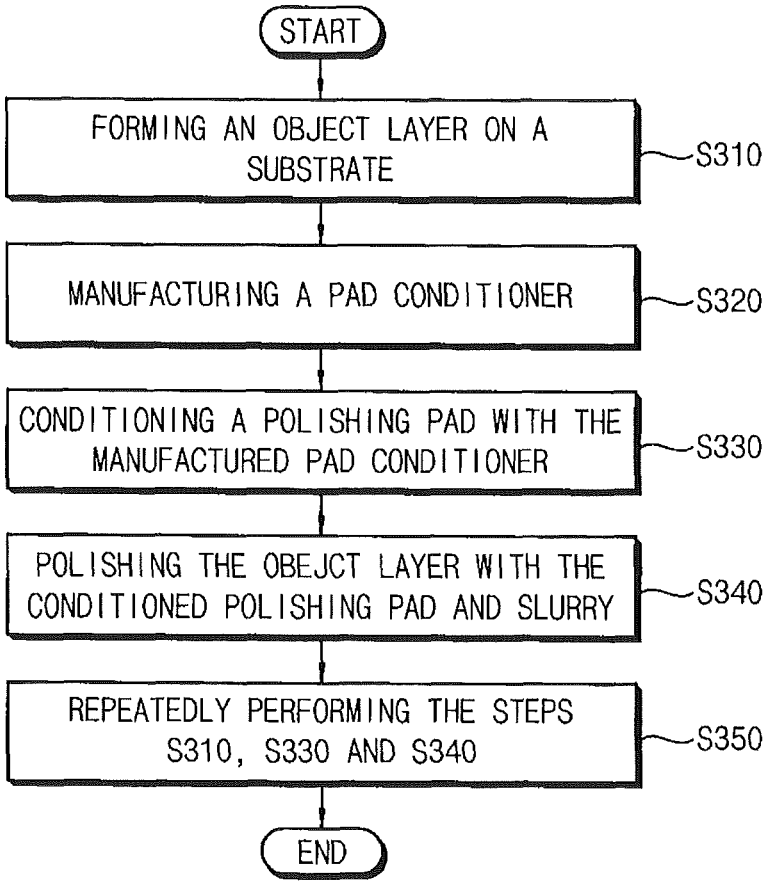

FIG. 14 is a flowchart illustrating a method of manufacturing a semiconductor device by polishing an object layer using a CMP apparatus including a pad conditioner, which may include artificial diamonds manufactured by a method of surface treatment in accordance with example embodiments.

Referring to FIGS. 12 and 14, in step S310, an object layer may be formed on a substrate, e.g., the wafer W. The object layer may include an insulating material or a conductive material.

In step S320, the pad conditioner 300 may be manufactured by the method illustrated with reference to FIGS. 8 to 10. Thus, the pad conditioner 300 including artificial diamonds having a regular or smooth surface, having no tips, or having a single crystalline structure may be manufactured.

In step S330, the polishing pad 430 may be conditioned by the pad conditioner 300. Surfaces of the artificial diamonds in the pad conditioner 300 that may contact a top surface of the polishing pad 430 may be treated as above, and thus no tips or parts of the artificial diamonds may be present that may be detached from the artificial diamonds to stick to the polishing pad 430 by the rubbing.

In step S340, the wafer W on which the object-layer is formed may be loaded to the polishing head 440 and mounted thereto. The object layer may be polished by a mechanical rubbing with the polishing pad 430 and a chemical reaction with the slurry 465. When the polishing pad 430 is conditioned by the pad conditioner 300 in step S330, the surfaces of the artificial diamonds in the pad conditioner 300 have been treated, and thus no tips or part of the artificial diamonds may be detached from the artificial diamonds.

In step S350, the steps S310, S330 and 340 may be repeatedly performed to polish the object layer so that the semiconductor device may be manufactured.

FIGS. 15, 17, 19, 21, 23, 25 and 27 are plan views illustrating stages of a method of manufacturing a semiconductor device in accordance with example embodiments, and FIGS. 16, 18, 20, 22, 24, 26 and 28 to 31 are cross-sectional views illustrating stages of a method of manufacturing the semiconductor device in accordance with example embodiments. Each of the cross-sectional views includes cross-sections of the corresponding plan view cut along lines G-G', H-H', K-K' and L-L', respectively. The lines G-G' and H-H' extend in a second direction substantially parallel to a top surface of a substrate, and the lines K-K' and L-L' extend in a first direction substantially parallel to the top surface of the substrate and substantially perpendicular to the second direction.

This method is an application of the method of manufacturing the semiconductor device illustrated with reference to FIG. 14 to a dynamic random access memory (DRAM) device.

Figure 15:
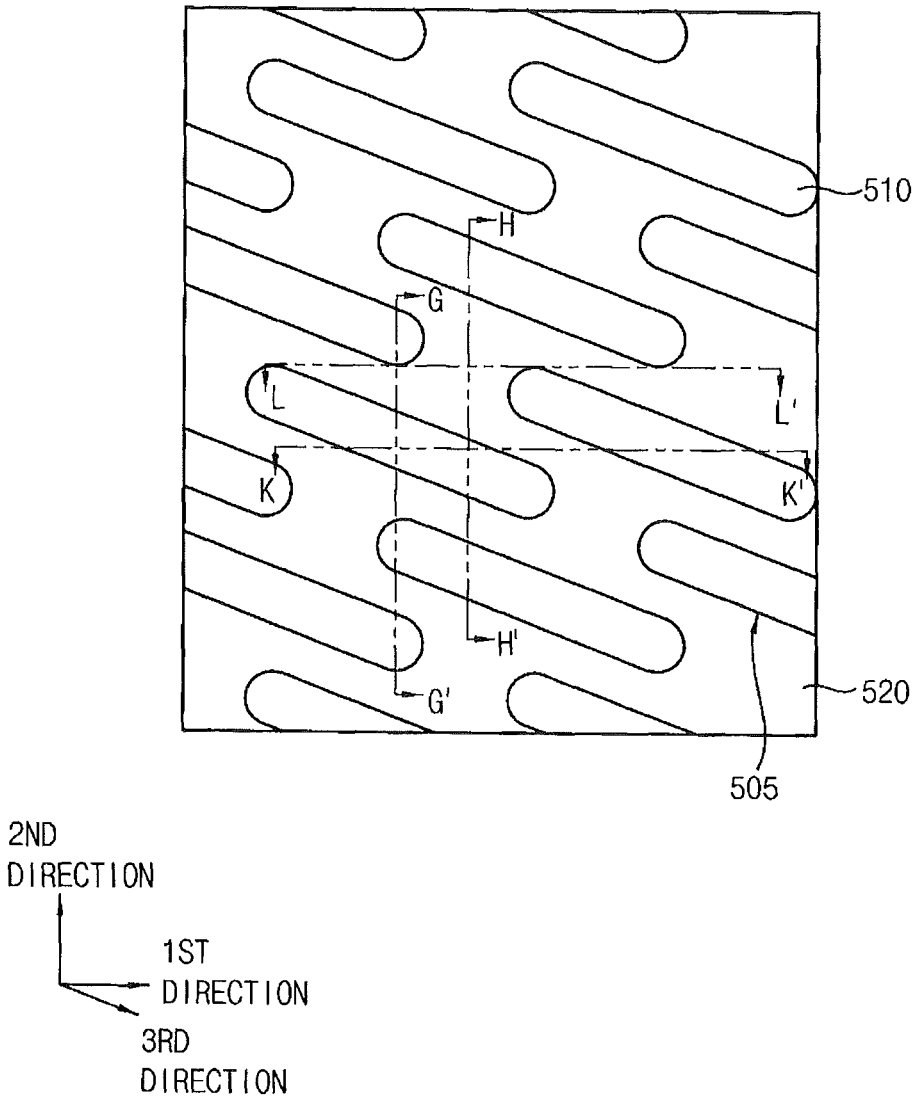
Figure 16:
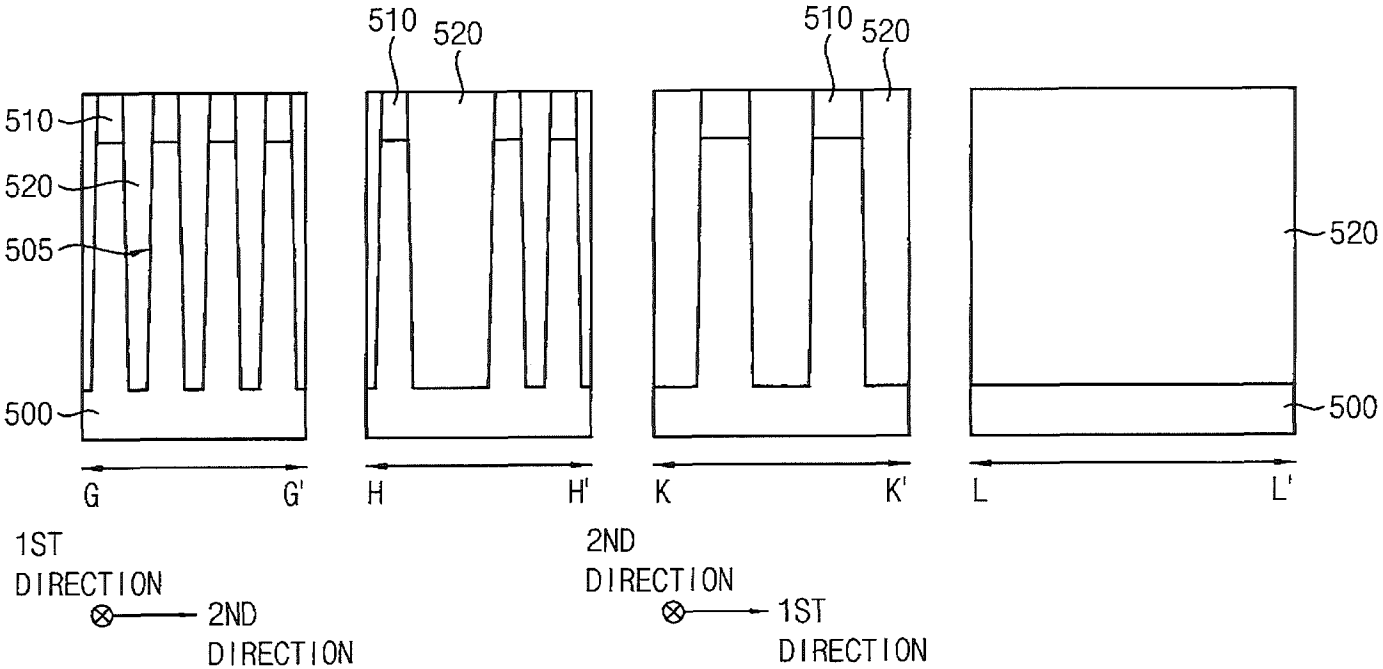

Referring to FIGS. 15 and 16, a first hard mask 510 may be formed on a substrate 500, and an upper portion of the substrate 500 may be etched using the first hard mask 510 as an etching mask to form a first trench 505. For example, the substrate 500 may be a silicon substrate, a germanium substrate, a silicon-germanium substrate, a silicon-on-insulator (SOI) substrate, a germanium-on-insulator (GOI) substrate, etc.

An isolation layer may be formed on the substrate 500 to sufficiently fill the first trench 505, and an upper portion of the isolation layer may be planarized until a top surface of the substrate 500 may be exposed to form an isolation layer pattern 520 in the first trench 505. The isolation layer may be formed to include an oxide, e.g., silicon oxide.

In example embodiments, the planarization process may be performed by a CMP process and/or an etch back process. The CMP process may be performed using the CMP apparatus of FIG. 12, and the CMP apparatus may include the pad conditioner (refer to FIG. 11) having the artificial diamonds of which surfaces have been treated by the apparatus of surface treatment illustrated with reference to FIGS. 1 to 6. Thus, when the polishing pad is conditioned with the pad conditioner, the artificial diamonds may not be detached from the pad conditioner to stick to the polishing pad, and thus, when the planarization process may be performed using the polishing pad, the substrate 500 and structures on the substrate 500 may not be damaged.

A region of the substrate 500 on which the isolation layer pattern 520 is formed may be defined as a field region, and a region of the substrate 500 on which no isolation layer pattern is formed may be defined as an active region. In example embodiments, a plurality of active regions may be formed, and each active region may extend in a third direction that is substantially parallel to the top surface of the substrate 500, however, neither parallel nor perpendicular to the first and second directions.

Impurities may be implanted into upper portions of the substrate 500 to form impurity regions. The impurity regions may form a transistor together with a first gate structure 560 (refer to FIG. 18) subsequently formed, and may serve as source/drain regions of the transistor.

Figure 17:
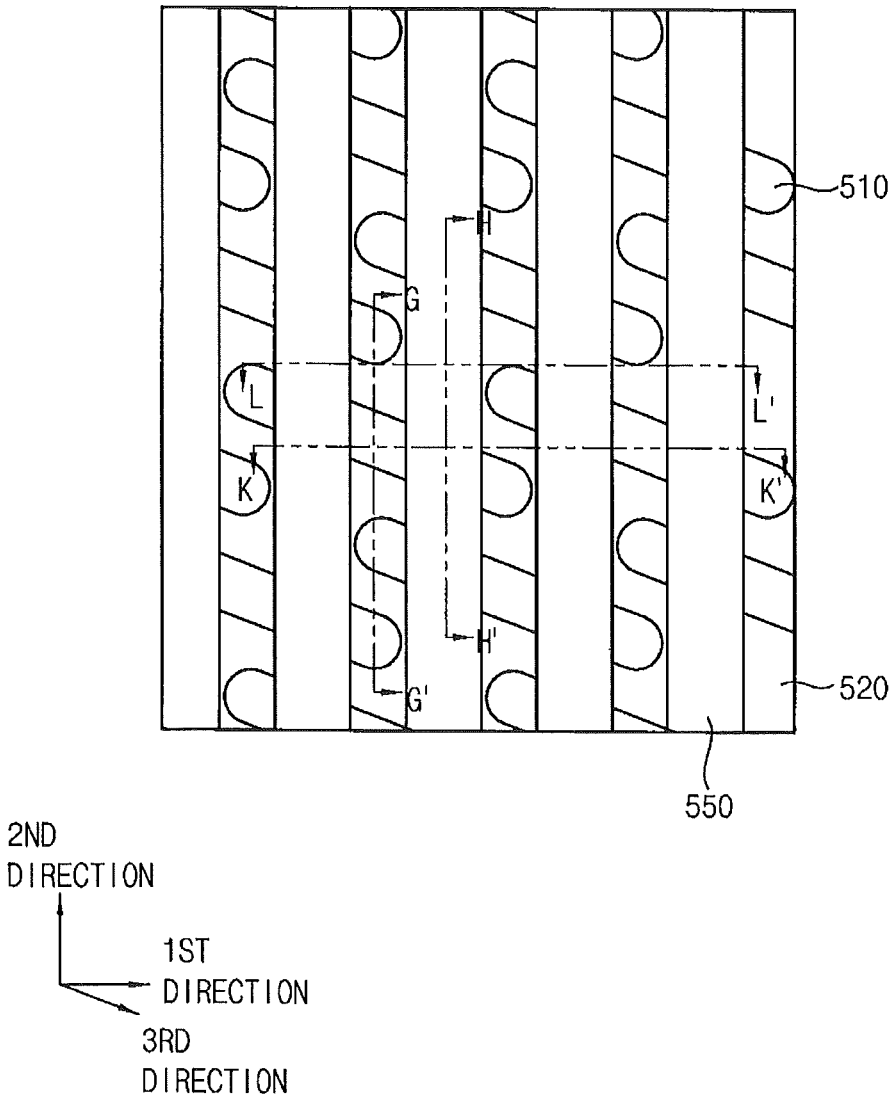
Figure 18:
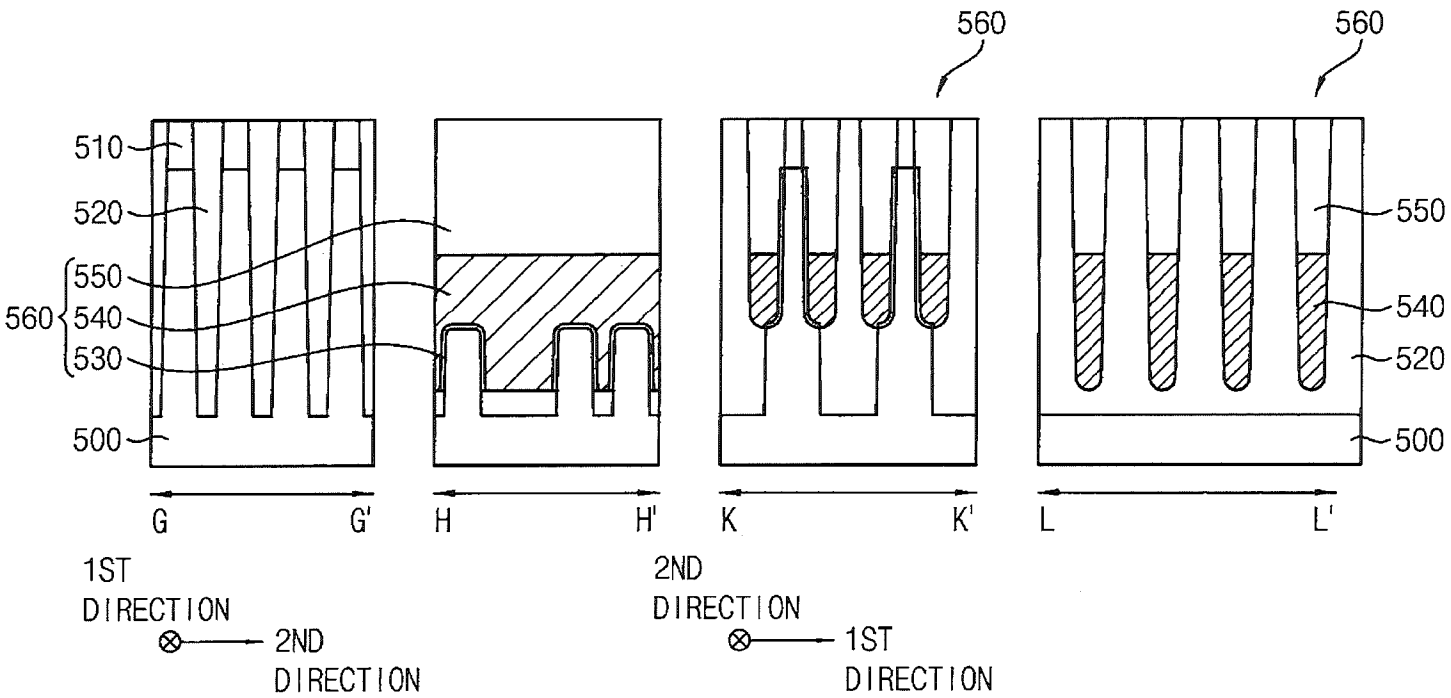

Referring to FIGS. 17 and 18, the first hard mask 510, the substrate 500 and the isolation layer pattern 520 may be partially removed to form second trenches each of which may extend in the second direction. The second trenches may be formed to have different depths at the substrate 500 and the isolation layer pattern 520 according to the etching selectivity therebetween. In example embodiments, two second trenches may be formed in each active region of the substrate 500.

A first gate insulation layer 530 may be formed on upper surfaces of the substrate 500 exposed by the second trenches, and a first gate electrode 540 and a capping layer pattern 550 may be sequentially formed in each second trench. The first gate electrode 540 may fill a lower portion of each second trench and the capping layer pattern 550 may fill an upper portion of each second trench.

In example embodiments, the first gate insulation layer 530 may be formed by a thermal oxidation process or a chemical vapor deposition (CVD) process, and thus may be formed to include an oxide, e.g., silicon oxide.

The first gate electrode 540 may be formed by forming a first gate electrode layer on the first gate insulation layer 530, the first hard mask 510 and the isolation layer pattern 520 to sufficiently fill the second trenches, and removing an upper portion of the first gate electrode layer through an etch back process and/or a CMP process. As described above, the CMP process may be performed using the CMP apparatus of FIG. 12, and the CMP apparatus may include the pad conditioner (refer to FIG. 11) having the artificial diamonds of which surfaces have been treated by the apparatus of surface treatment illustrated with reference to FIGS. 1 to 6. Thus, when the polishing pad is conditioned with the pad conditioner, the artificial diamonds may not be detached from the pad conditioner to stick to the polishing pad, and thus, when the planarization process may be performed using the polishing pad, the substrate 500 and structures on the substrate 500 may not be damaged.

The first gate electrode layer may be formed to include a metal, e.g., tungsten, titanium, tantalum, etc., or a metal nitride, e.g., tungsten nitride, titanium nitride, tantalum nitride, etc.

The capping layer pattern 550 may be formed by forming a capping layer on the first gate electrode 540, the first gate insulation layer 530, the first hard mask 510 and the isolation layer pattern 520 to sufficiently fill remaining portions of the second trenches, and planarizing an upper portion of the capping layer until top surfaces of the first hard mask 510 and the isolation layer pattern 520 may be exposed. In example embodiments, the planarization process may be performed by a CMP process. The capping layer may be formed to include a nitride, e.g., silicon nitride.

By the above process, the first gate structure 560 including the first gate insulation layer 530, the first gate electrode 540 and the capping layer pattern 550 may be formed in each second trench. In example embodiments, the first gate structure 560 may extend in the second direction.

Figure 19:
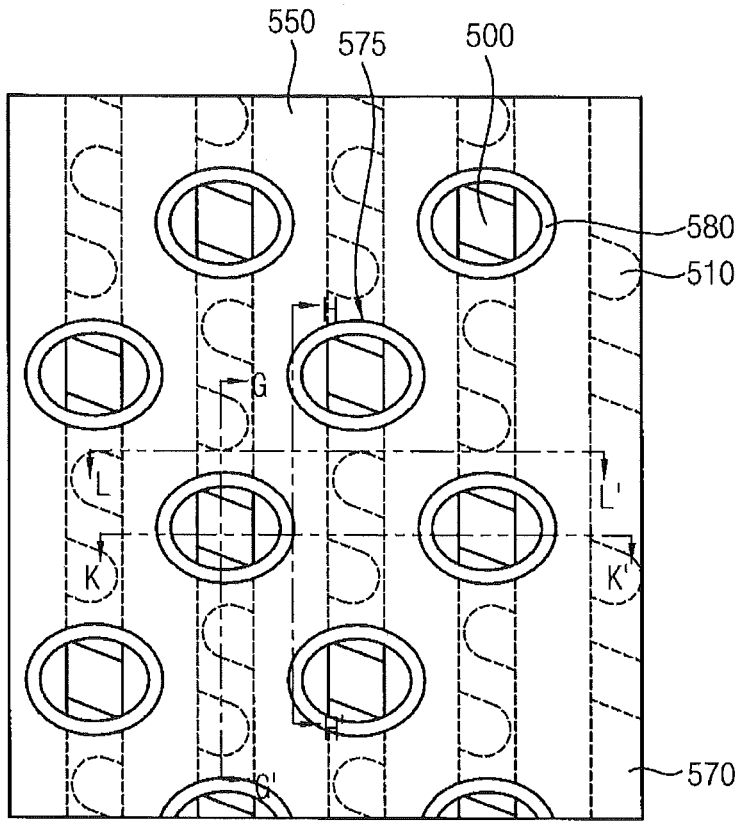
Figure 19:
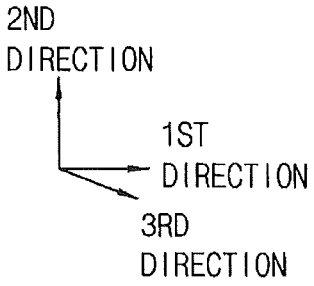
Figure 20:
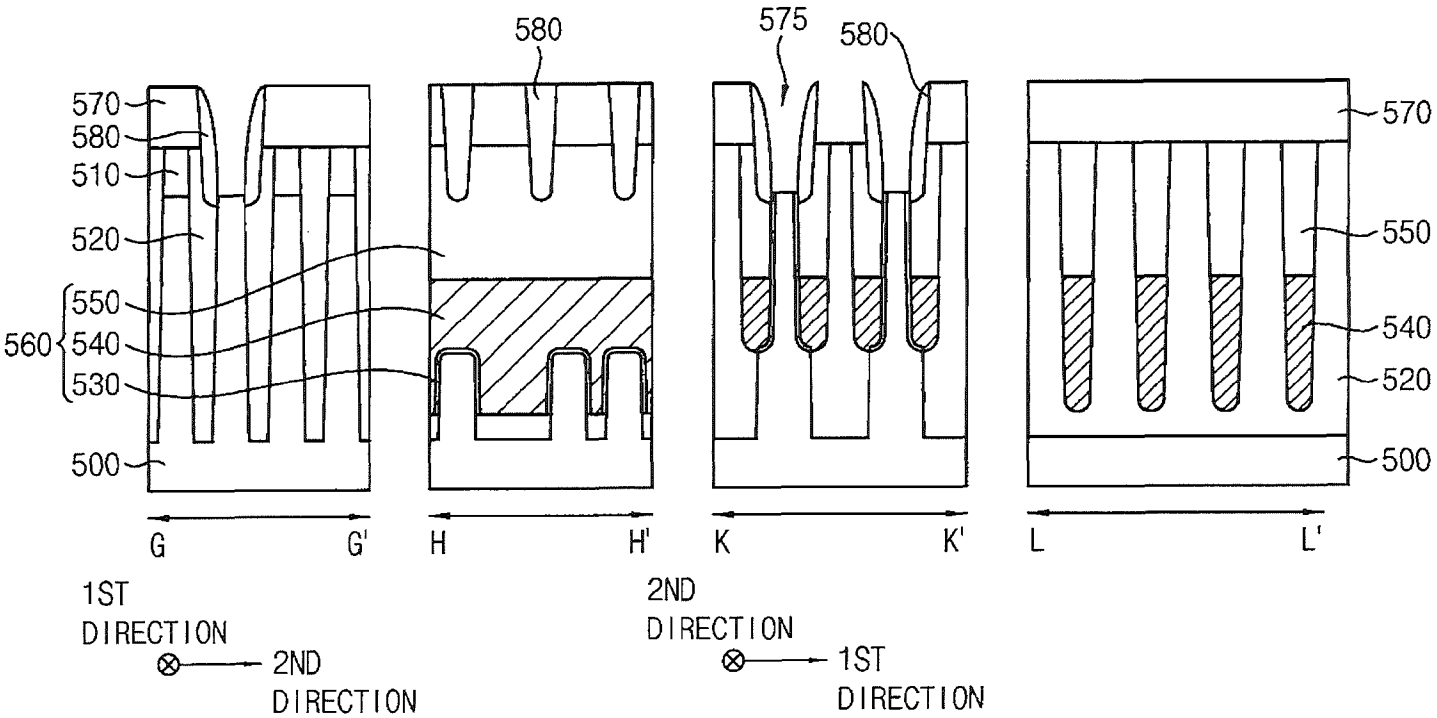

Referring to FIGS. 19 and 20, a first insulating interlayer 570 may be formed on the first hard mask 510, the isolation layer pattern 520 and the capping layer pattern 550, and the first insulating interlayer 570 and the first hard mask 510 may be partially removed to form first contact holes or openings 575 exposing the active regions of the substrate 500, respectively. In example embodiments, each first contact hole 575 may expose a central top surface of each active region. When the first contact holes 575 are formed, the capping layer pattern 550 and the isolation layer pattern 520 may be also partially removed.

A first spacer 580 may be formed on a sidewall of each first contact hole 575. The first spacers 580 may be formed by forming a first spacer layer on the sidewalls of the first contact holes 575, the exposed top surface of the active regions and the first insulating interlayer 570, and anisotropically etching the first spacer layer. The first spacer layer may be formed to include a nitride, e.g., silicon nitride.

Figure 21:
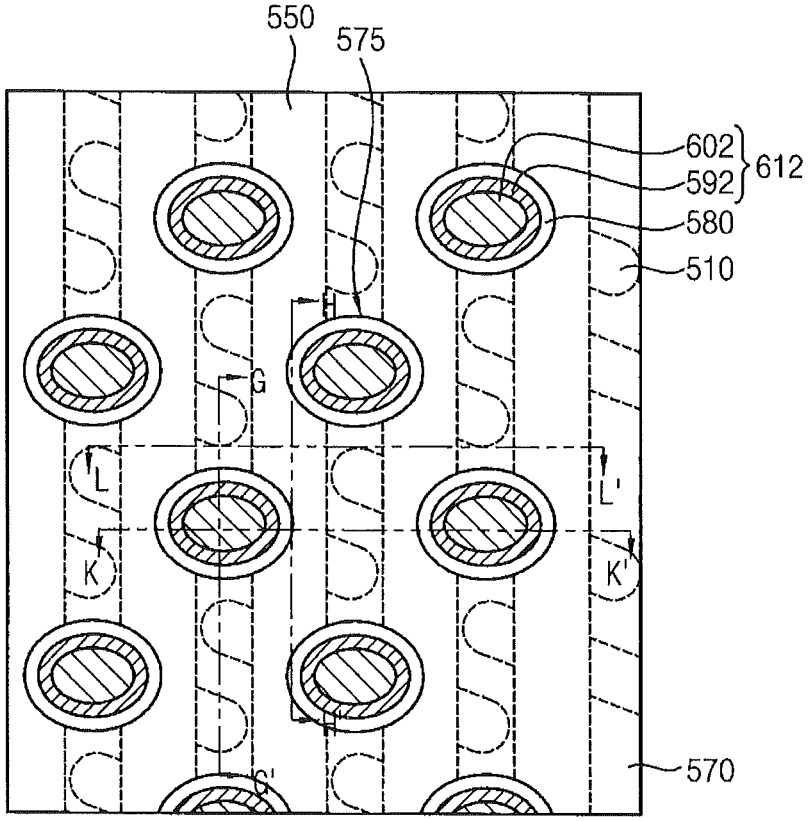
Figure 21:
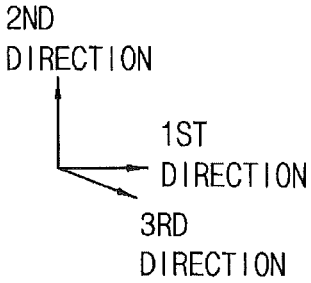
Figure 22:
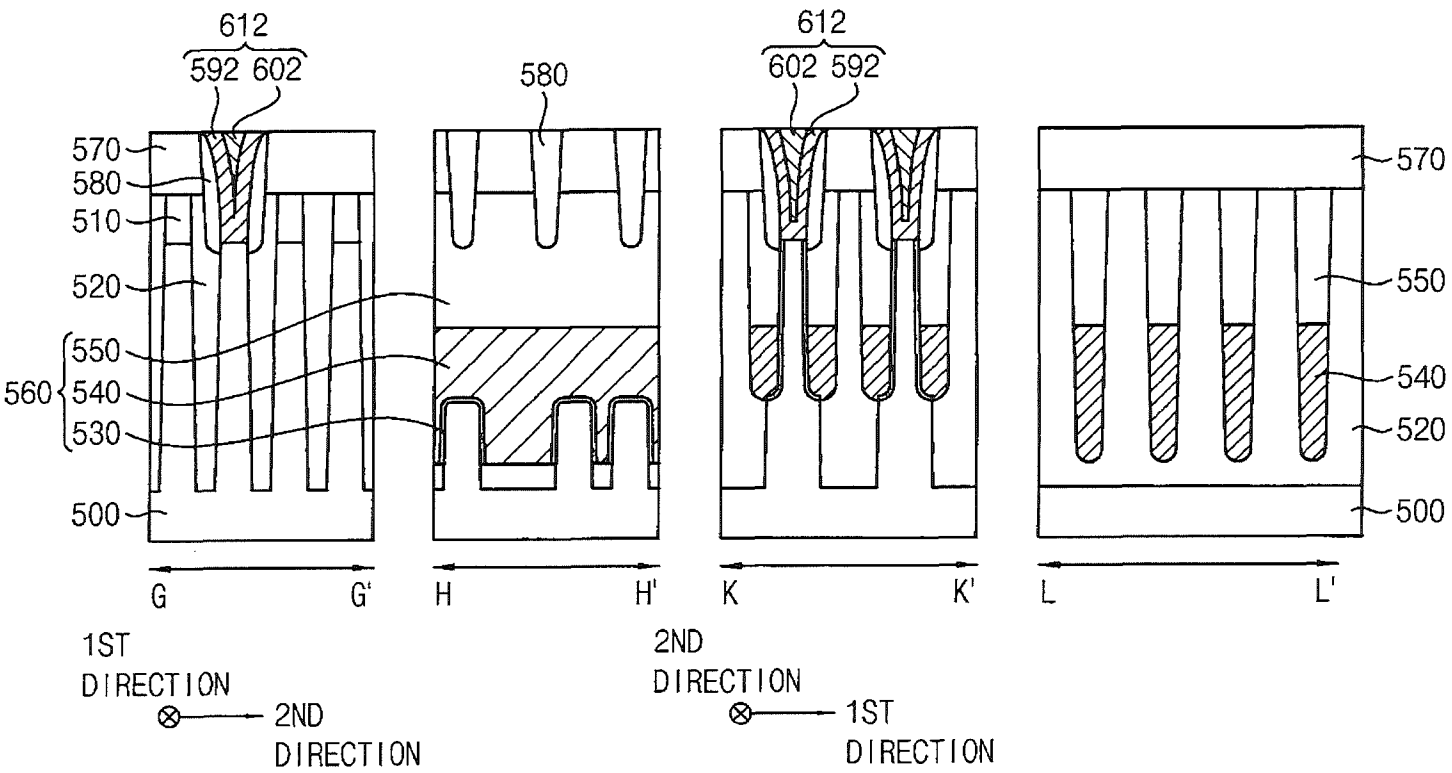

Referring to FIGS. 21 and 22, a first contact plug 612 filling a remaining portion of each first contact hole 575 may be formed on the exposed top surface of the active region and the first spacer 580. The first contact plug 612 may include a first metal layer pattern 602 and a barrier layer pattern 592 surrounding the first metal layer pattern 602.

The first contact plugs 612 may be formed by forming a barrier layer on the exposed top surface of the active regions, the first spacers 580 and the first insulating interlayer 570, forming a first metal layer to sufficiently fill remaining portions of the first contact holes 575, and planarizing upper portions of the barrier layer and the first metal layer until a top surface of the first insulating interlayer 570 may be exposed. In example embodiments, the planarization process may be performed by a CMP process.

The barrier layer may be formed to include a metal nitride, e.g., tungsten nitride, titanium nitride, tantalum nitride, etc., and the first metal layer may be formed to include a metal, e.g., tungsten, aluminum, copper, etc. Alternatively, the first contact plugs 612 may be formed to include doped polysilicon.

Figure 23:
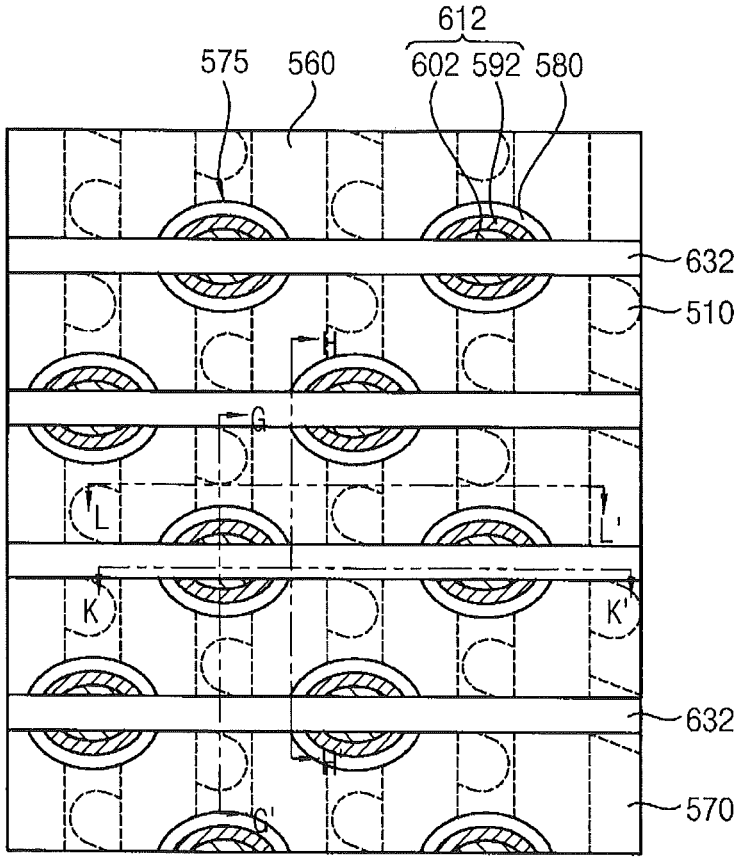
Figure 23:
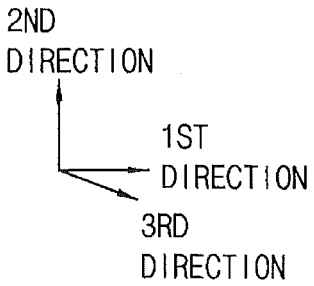
Figure 24:
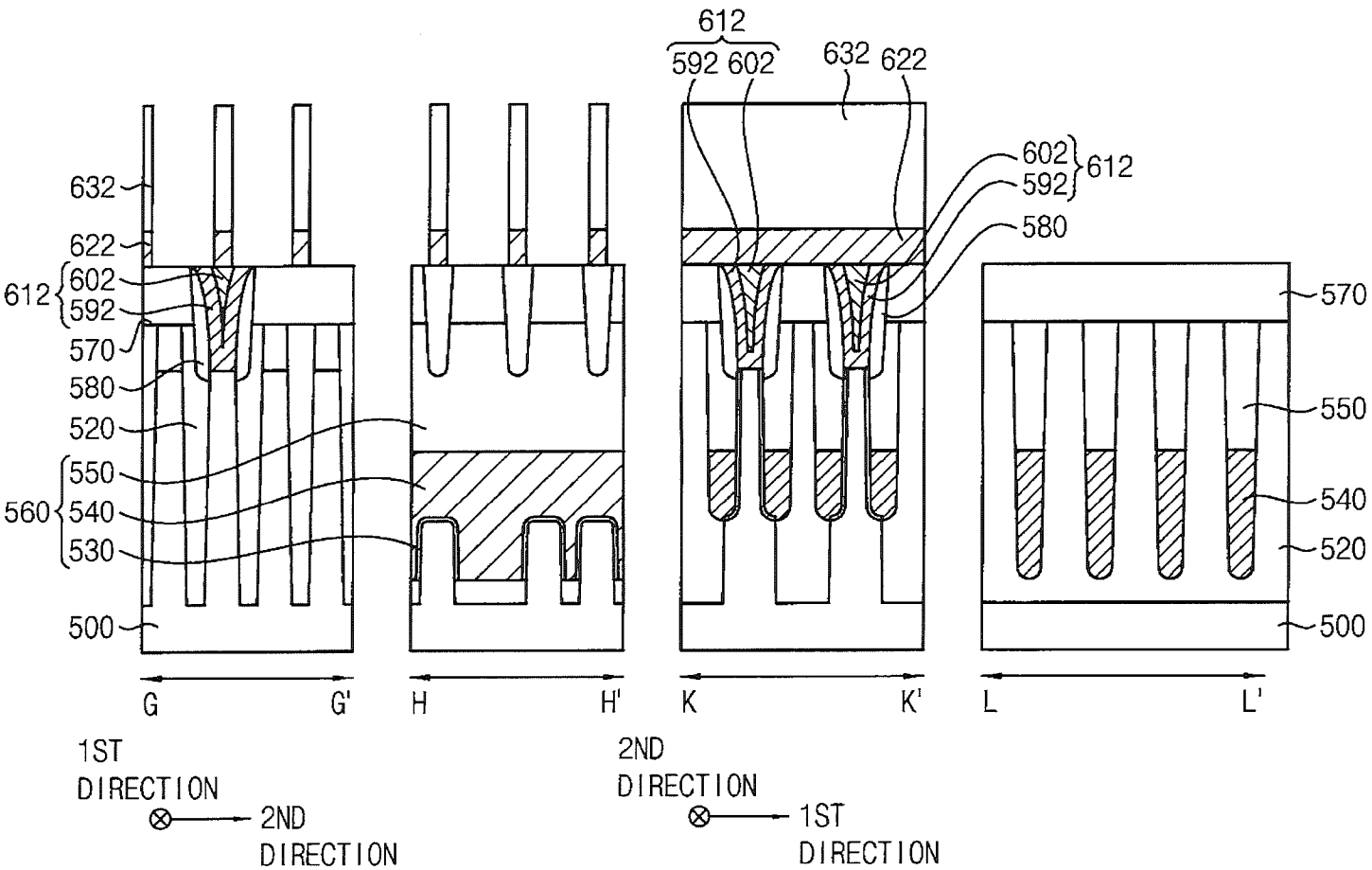

Referring to FIGS. 23 and 24, a first bit line 622 and a second hard mask 632 may be sequentially formed on the first insulating interlayer 570 to contact the first plugs 612.

The first bit line 622 and the second hard mask 632 may be formed by sequentially forming a second metal layer and a second hard mask layer on the first insulating interlayer 570, the first contact plugs 612 and the first spacers 580, and patterning the second hard mask layer and the second metal layer through a photolithography process. In example embodiments, each of the first bit line 622 and the second hard mask 632 may extend in the first direction, and a plurality of first bit lines 622 and a plurality of second hard mask 632 may be formed in the second direction. The second metal layer may be formed to include a metal, e.g., tungsten, aluminum, copper, etc., and the second hard mask layer may be formed to include a nitride, e.g., silicon nitride.

Figure 25:
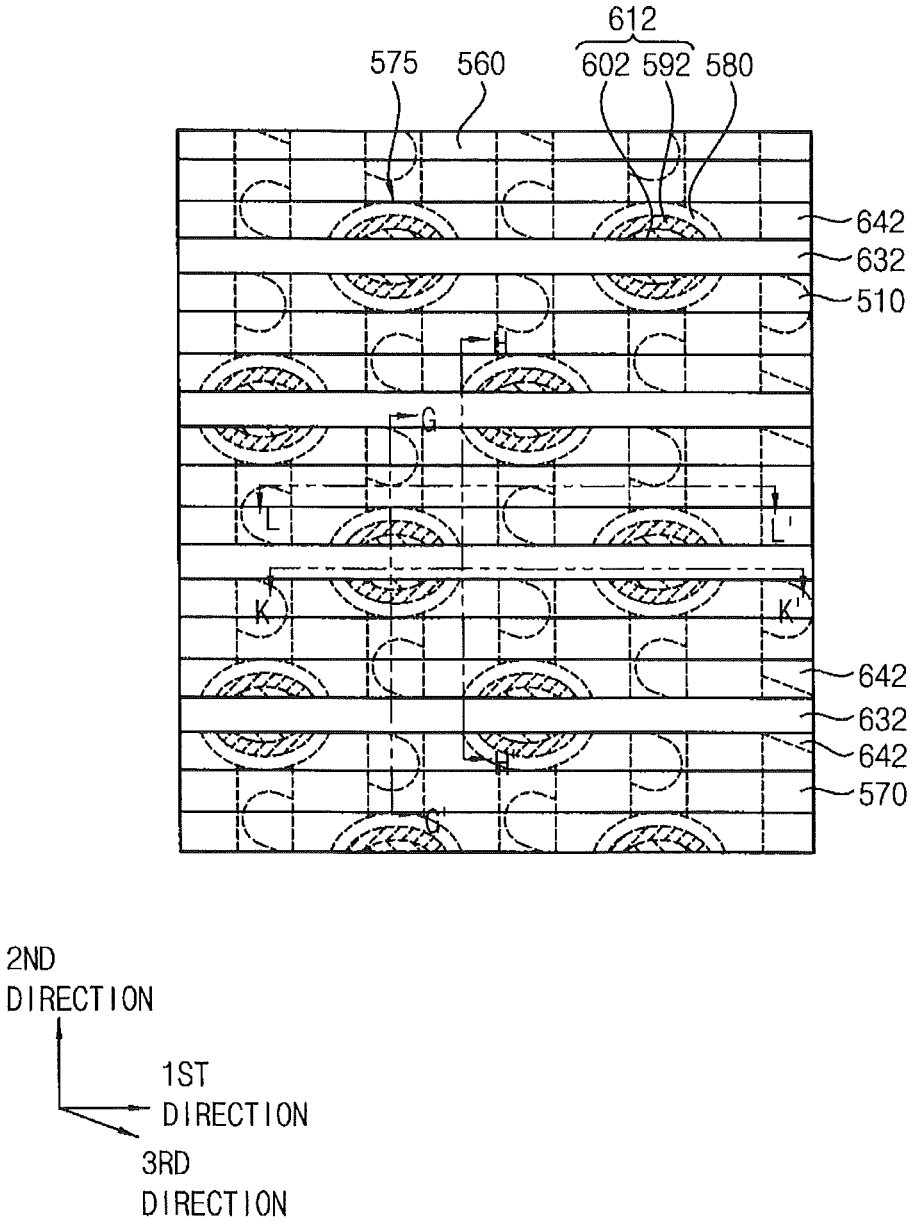
Figure 26:
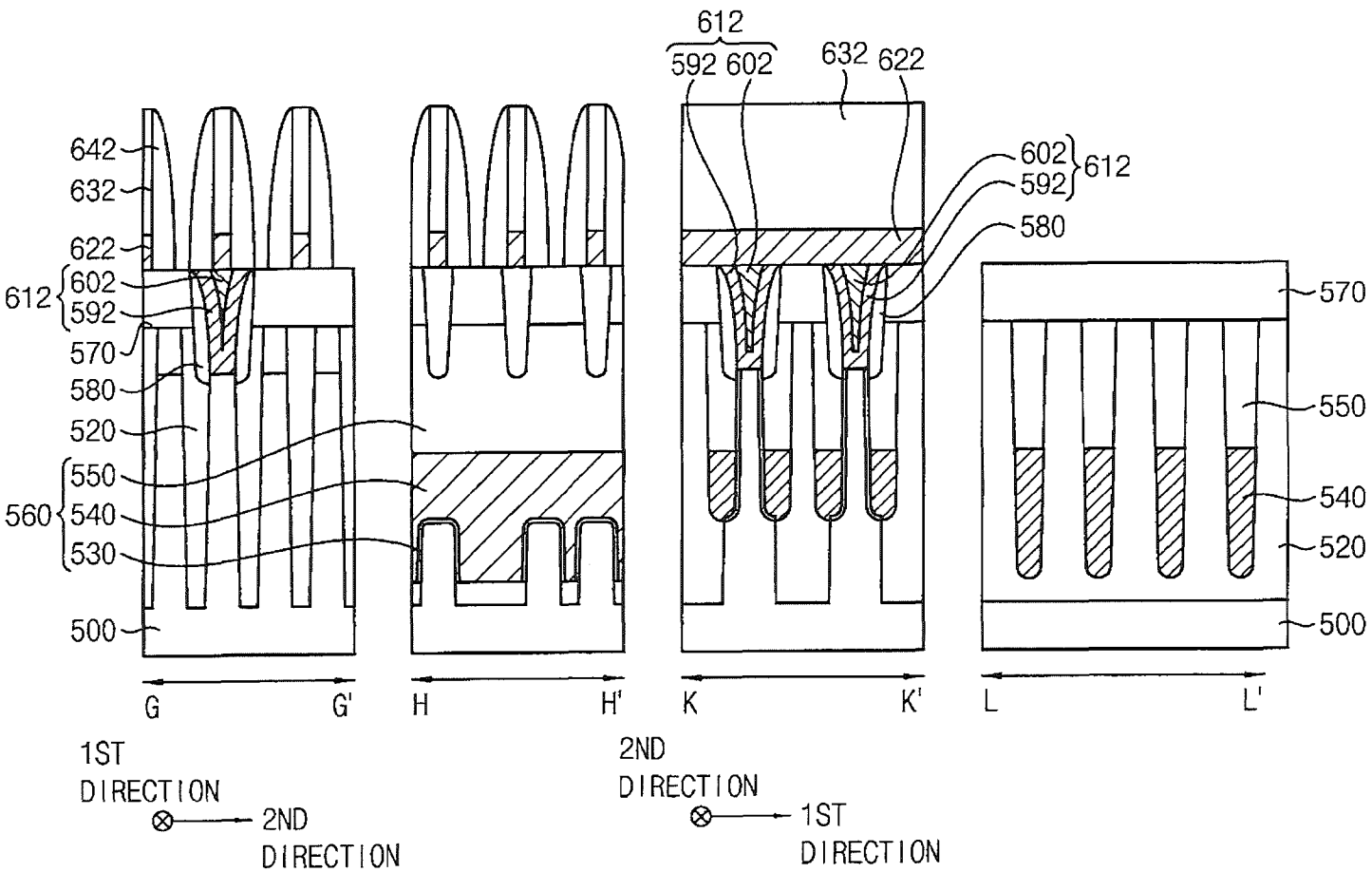

Referring to FIGS. 25 and 26, a second spacer 642 may be formed on sidewalls of each first bit line 622 and each second hard mask 632.

The second spacers 642 may be formed by forming a second spacer layer on the first bit lines 622, the second hard masks 632, the first contact plugs 612 and the first insulating interlayer 570, and anisotropically etching the second spacer layer. The second spacer layer may be formed to include a nitride, e.g., silicon nitride. In example embodiments, the second spacer 642 may extend in the first direction, and a plurality of second spacers 642 may be formed in the second direction.

The bit line 622, the second hard mask 632 and the second spacer 642 may define a first bit line structure.

Figure 27:
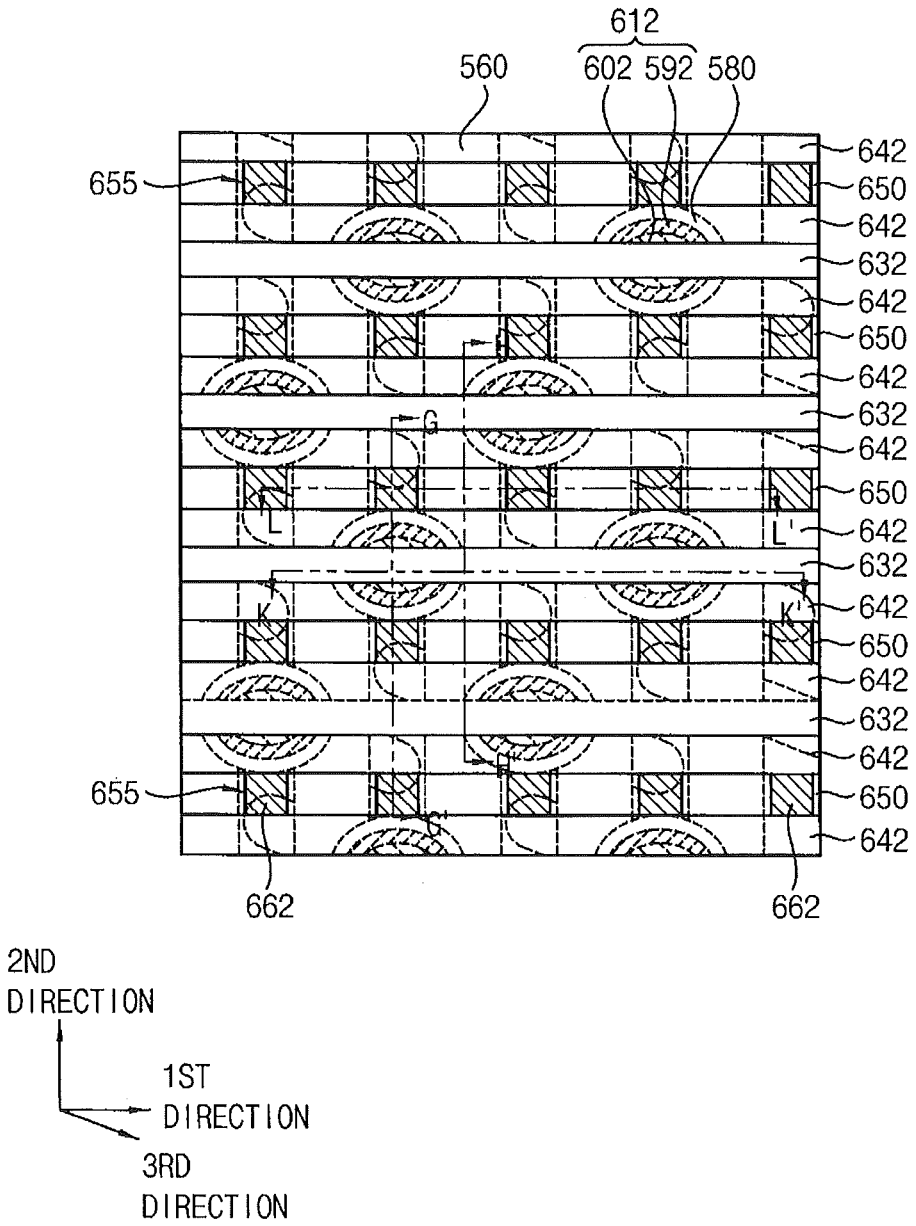
Figure 28:
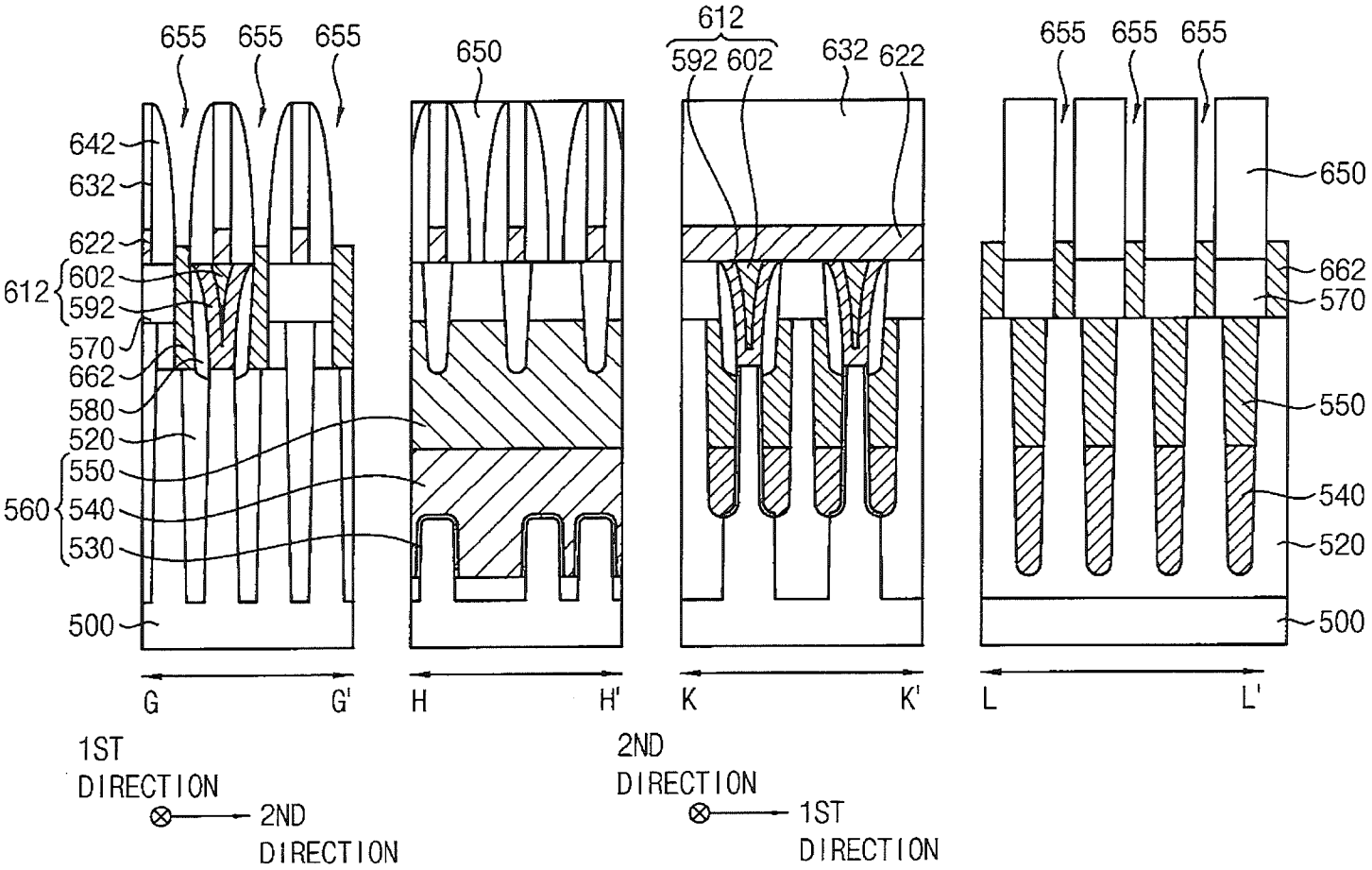

Referring to FIGS. 27 and 28, a second insulating interlayer 650 may be formed on the first insulating interlayer 570 to cover the first bit line structures, and the second insulating interlayer 650, the first insulating interlayer 570 and the first hard mask 510 may be partially etched to form second contact holes or openings 655 exposing top surfaces of the active regions, respectively. When the second contact holes 655 are formed, the isolation layer pattern 520 may be partially etched. In example embodiments, a plurality of second contact holes 655 may be formed in the first direction between the first bit line structures. In example embodiments, the second contact holes 655 may be formed to be self-aligned with the first bit line structures, and two second contact holes 655 may be formed on each active region.

A second contact plug 662 filling a lower portion of each second contact hole 655 may be formed. The second contact plugs 662 may be formed by forming a first conductive layer on the exposed top surfaces of the active regions, the first bit line structures and the second insulating interlayer 650 to sufficiently fill the second contact holes 655, and removing an upper portion of the first conductive layer. The first conductive layer may be formed to include, e.g., doped polysilicon.

Figure 29:
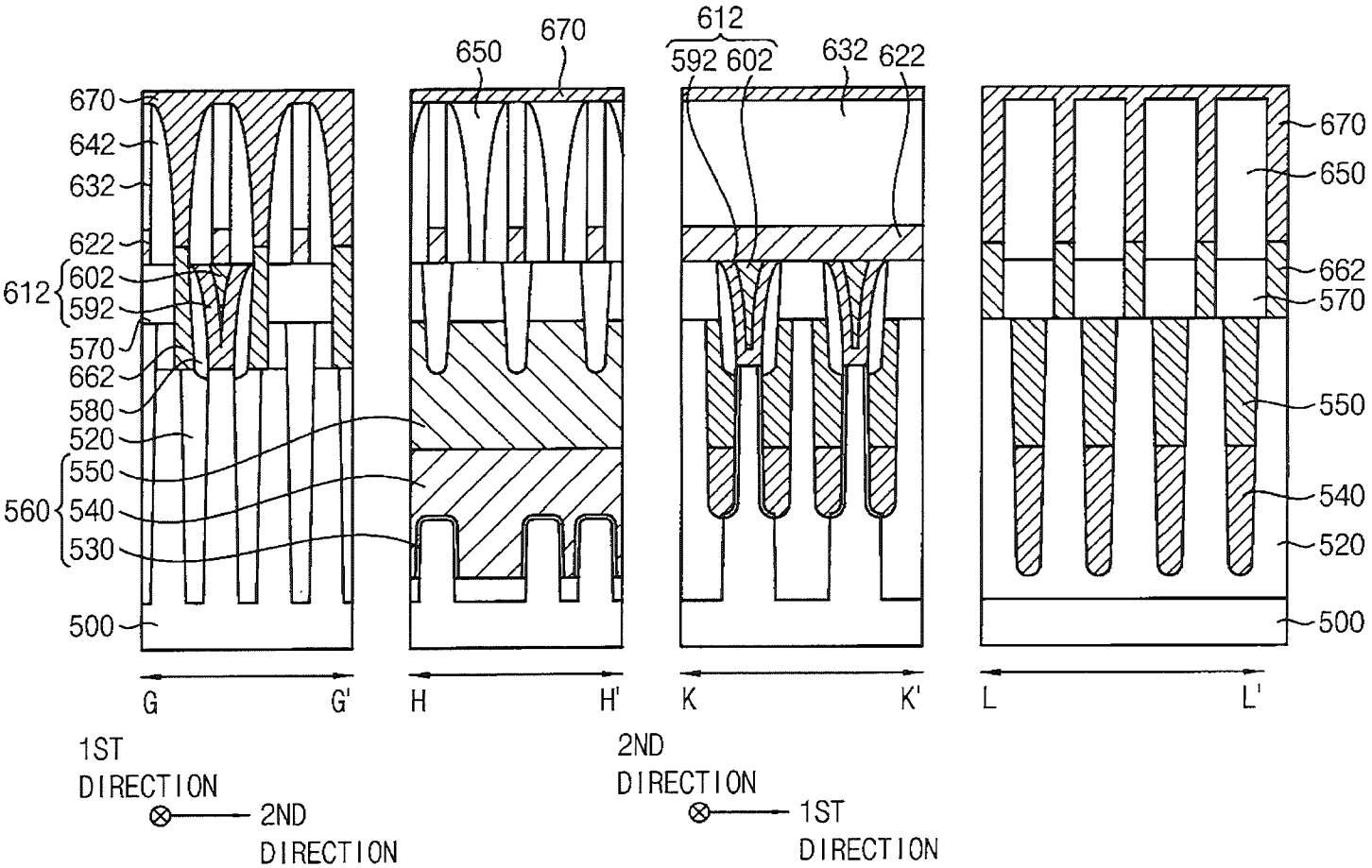

Metal silicide patterns may be further formed on top surfaces of the second contact plugs 662, thereby reducing a resistance between the second contact plugs 662 and landing pads 672 (refer to FIG. 30) subsequently formed, Referring to FIG. 29, a second conductive layer 670 may be formed on the second contact plugs 662, the first bit line structures and the second insulating interlayer 650 to sufficiently fill remaining portions of the second contact holes 655. The second conductive layer 670 may be formed to include a metal, e.g., tungsten, aluminum, copper, etc.

An upper portion of the second conductive layer 670 may be planarized by a CMP process.

Figure 30:
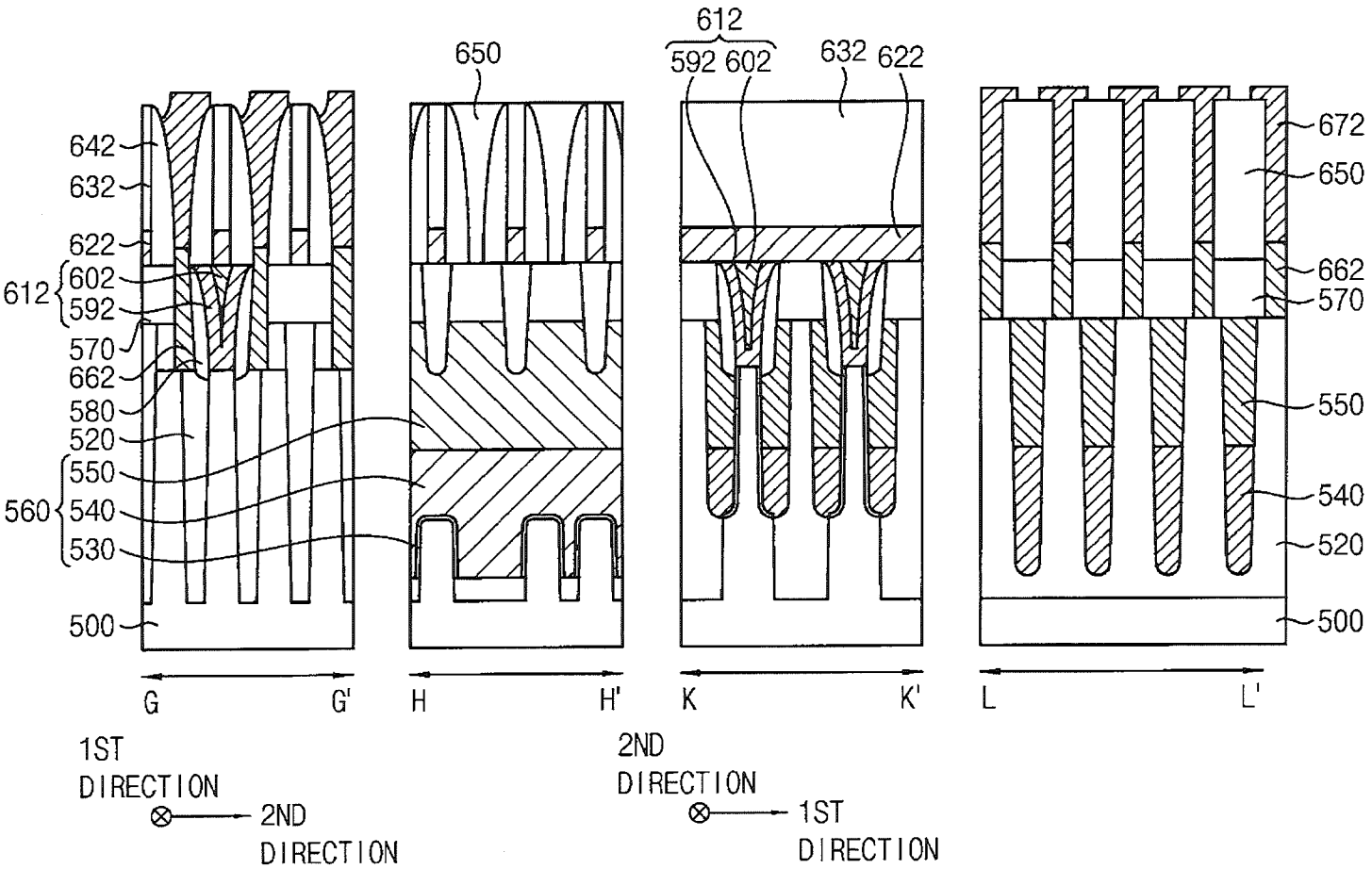

Referring to FIG. 30, an upper portion of the second conductive layer 670 may be patterned to form a plurality of landing pads 672. A lower portion of each landing pad 672 may contact a top surface of each second contact plug 662.

Figure 31:
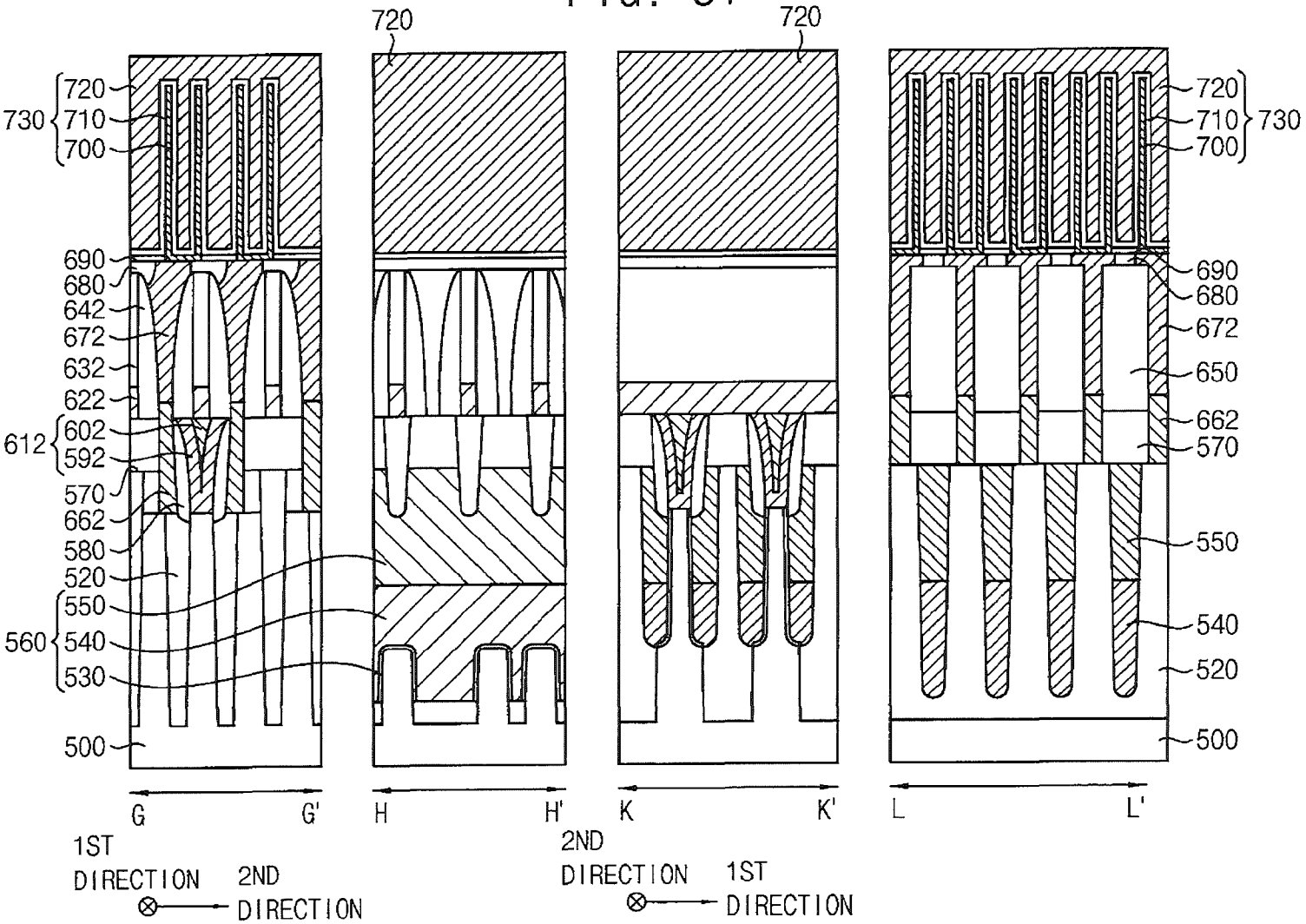

Referring to FIG. 31, capacitors 730 contacting the landing pads 672, respectively, may be formed to complete the semiconductor device.

That is, a third insulating interlayer 680 may be formed on the first bit line structures and the second insulating interlayer 650 to cover the landing pads 672, an upper portion of the third insulating interlayer 680 may be planarized until a top surface of the landing pads 672 may be exposed. An etch stop layer 690 and a mold layer may be sequentially formed on the third insulating interlayer 680 and the landing pads 672, and may be partially etched to form third contact holes exposing top surfaces of the landing pads 672, respectively. In the etching process, a top surface of the third insulating interlayer 680 may be also partially exposed.

After a lower electrode layer may be formed on sidewalls of the third contact holes, the exposed top surfaces of the landing pads 672, the exposed top surface of the third insulating interlayer 680 and the mold layer, a sacrificial layer may be formed on the lower electrode layer to sufficiently fill remaining portions of the third contact holes, and upper portions of the sacrificial layer and the lower electrode layer may be planarized until a top surface of the mold layer may be exposed to divide the lower electrode layer into a plurality of pieces. The planarization process may be performed by a CMP process.

The sacrificial layer and the mold layer may be removed. Thus, a plurality of cylindrical lower electrodes 700 may be formed on the sidewalls of the third contact holes, the exposed top surfaces of the landing pads 672, and the exposed top surface of the third insulating interlayer 680. Alternatively, a plurality of pillar-shaped lower electrodes may be formed instead of the plurality of cylindrical lower electrodes 700, and in this case, the lower electrode layer may entirely fill the third contact holes and the sacrificial layer may not be formed. Hereinafter, only the case in which the cylindrical lower electrodes 700 are formed will be illustrated.

A dielectric layer 710 may be formed on the lower electrodes 700 and the etch stop layer 690, and an upper electrode 720 may be formed on the dielectric layer 710 to form the capacitors 730, each of which may include the lower electrode 700, the dielectric layer 710 and the upper electrode 720. The lower and upper electrodes 700 and 720 may be formed to include doped polysilicon, a metal, a metal nitride, etc., and the dielectric layer 710 may be formed to include a metal oxide, silicon oxide, etc.

As illustrated above, various types of layers may be planarized by a CMP process, and the substrate 500 and the structures on the substrate 500 may not be damaged.

FIGS. 32 to 37 are cross-sectional views illustrating stages of a method of manufacturing a semiconductor device in accordance with example embodiments. This method is an application of the method of manufacturing the semiconductor device illustrated with reference to FIG. 14 to a flash memory device.

Figure 32:
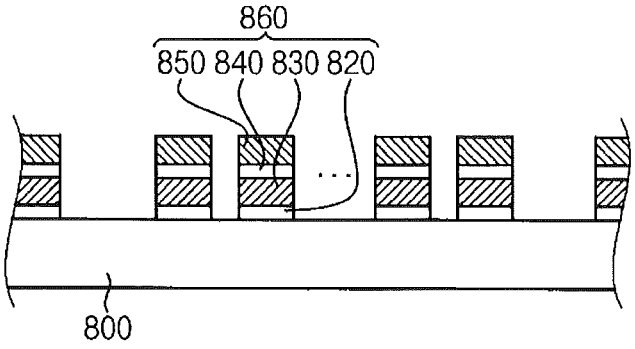

Referring to FIG. 32, a plurality of gate structures 860 may be formed on a substrate 800.

The substrate 800 may be divided into an active region and a field region by an isolation layer. In example embodiments, the active region may extend in a first direction parallel with a top surface of the substrate 800, and a plurality of active regions may be formed in a second direction substantially perpendicular to the first direction. The substrate 800 may include a cell region in which memory cells may be formed and a peripheral region in which peripheral circuits may be formed. In FIGS. 32 to 37, only the active region in the cell region may be illustrated.

Each gate structure 860 may be formed by sequentially forming and patterning a tunnel insulation layer, a floating gate layer, a dielectric layer and a control gate layer on the substrate 800. In an example embodiment, after forming a gate mask on the control gate layer, the control gate layer, the dielectric layer, the floating gate layer and the tunnel insulation layer may be patterned using the gate mask as an etching mask to form the gate structures 860. Thus, each gate structure 860 may be formed to include a tunnel insulation layer pattern 820, a floating gate 830, a dielectric layer pattern 840 and a control gate 850 sequentially stacked on the substrate 800. In example embodiments, a plurality of gate structures 860 may be formed in the first direction.

The tunnel insulation layer may be formed using an oxide, e.g., silicon oxide, an oxynitride, e.g., silicon oxynitride, silicon oxide doped with impurities or a low-k dielectric material, etc., and the floating gate layer may be formed using doped polysilicon, a metal having a high work function, e.g., tungsten, titanium, cobalt, nickel, etc. The dielectric layer may be formed using an oxide and/or a nitride to have an ONO structure or using a metal oxide having a high dielectric constant. The high-k metal oxide may include, e.g., hafnium oxide, titanium oxide, tantalum oxide, zirconium oxide, aluminum oxide, etc. The control gate layer may be formed using doped polysilicon, a low resistance metal, e.g., aluminum, copper, etc., a metal nitride, a metal silicide, etc.

In example embodiments, the tunnel insulation layer patterns 820 may be formed to have an island shape from or relative to each other on the active region of the substrate 800, and the floating gates 830 may be also formed to have an island shape from each other thereon. Each of the dielectric layer patterns 840 and the control gates 850 may be formed to extend in the second direction on the floating gates 830 and the isolation layer. Alternatively, the tunnel insulation layer patterns 820 may be formed not to have an island shape but to extend in the first direction on the active region of the substrate 800.

Figure 33:
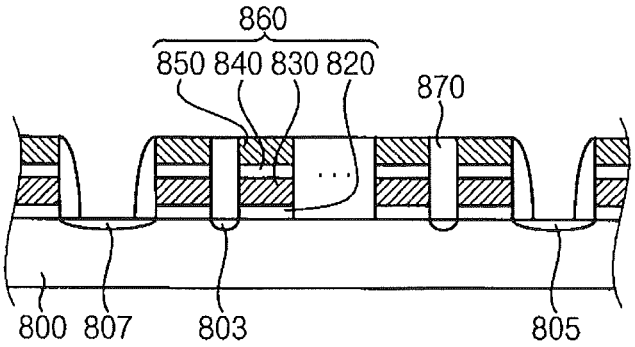

Referring to FIG. 33, an ion implantation process may be performed using the gate structures 860 as an ion implantation mask to form first, second and third impurity regions 803, 805 and 807 at upper portions of the active region of the substrate 800 adjacent to the gate structures 860.

A spacer layer may be formed on the substrate 800 to cover the gate structures 860. The spacer layer may be formed using a nitride, e.g., silicon nitride by a CVD process, an ALD process, a sputtering process, etc. The spacer layer may be etched by an anisotropic etching process to form spacers 870 on sidewalls of the gate structures 860. Spaces between the gate structures 860 spaced apart from each other at a relatively small distance may be filled with the spacers 870.

Figure 34:
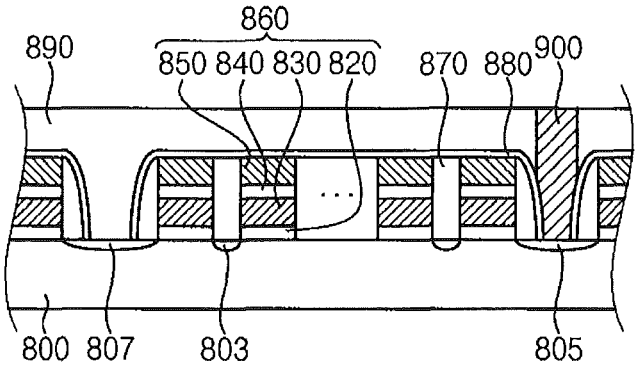

Referring to FIG. 34, a protection layer may be formed on the spacers 870 and the gate structures 860. The protection layer may be formed using a nitride, e.g., silicon nitride by a CVD process, an ALD process, a sputtering process, etc. The protection layer may be partially etched by an anisotropic process to form a protection layer pattern 880.

A first insulating interlayer 890 covering the protection layer pattern 880 may be formed on the substrate 800. The first insulating interlayer 890 may be formed using silicon oxide, e.g., borophosphosilicate glass (BPSG), undoped silicate glass (USG), spin-on glass (SOG), etc., by a chemical vapor deposition (CVD) process, an ALD process, a sputtering process, etc.

A first opening may be formed through the first insulating interlayer 890 to expose the second impurity region 805, and a first conductive layer filling the first opening may be formed on the exposed second impurity region 805 and the first insulating interlayer 890. The first conductive layer may be formed using doped polysilicon, a metal or a metal silicide. The first conductive layer may be planarized until the first insulating interlayer 890 may be exposed to form a CSL 900 filling the first opening and making contact with the second impurity region 805. In example embodiments, the planarization process may be performed by a CMP process.

Figure 35:
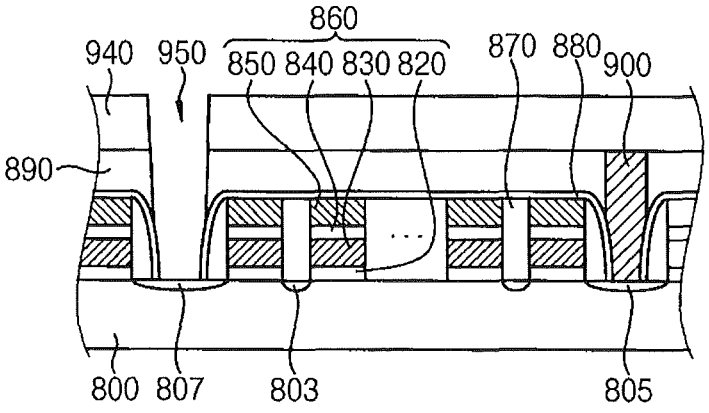

Referring to FIG. 35, a second insulating interlayer 940 may be formed on the first insulating interlayer 890 and the CSL 900, and a second opening 950 may be formed through the first and second insulating interlayers 890 and 940 to expose the third impurity region 807.

Figure 36:
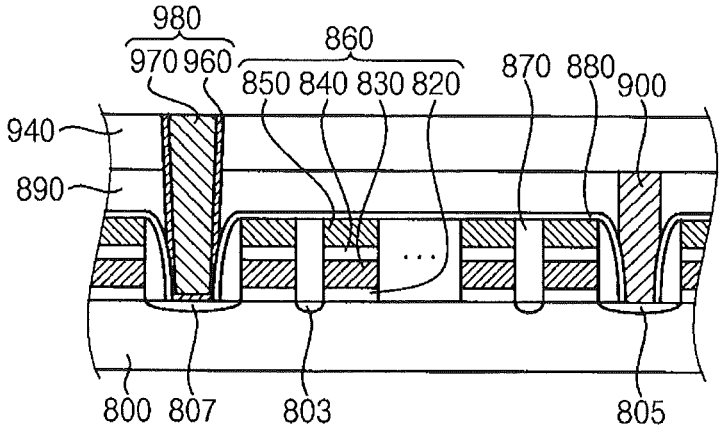

Referring to FIG. 36, a contact plug 980 filling the second opening 950 may be formed.

Particularly, a barrier layer may be formed on the exposed top surfaces of the third impurity region 807 and sidewalls of the second opening 950, and a second conductive layer sufficiently filling the second opening 950 may be formed on the barrier layer. Upper portions of the second conductive layer and the barrier layer may be planarized until a top surface of the second insulating interlayer 940 may be exposed. The planarization process may be performed by a CMP process. In example embodiments, the barrier layer may be formed using a metal or a metal nitride, and the second conductive layer may be formed using a low resistance metal, e.g., aluminum, copper, etc., a metal nitride and/or a metal silicide.

The contact plug 980 may include a barrier layer pattern 960 and a second conductive layer pattern 970. In example embodiments, the contact plug 980 may serve as a bit line contact plug.

Figure 37:
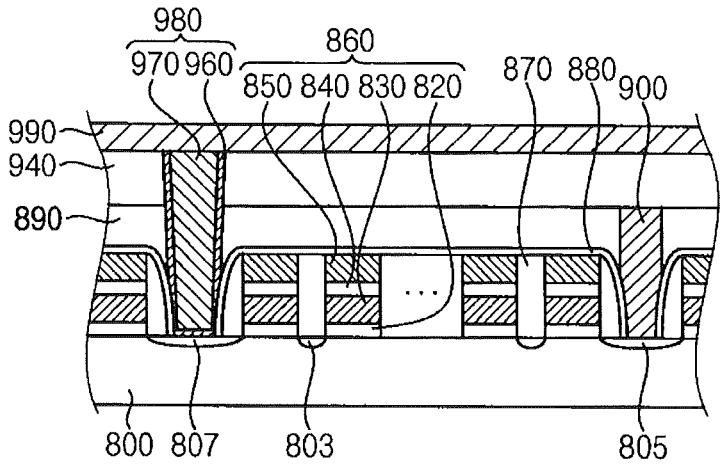

Referring to FIG. 37, a bit line 990 may be formed to extend in the first direction.

As illustrated above, various types of layers may be planarized by a CMP process, and the substrate 800 and the structures on the substrate 800 may not be damaged in the CMP process.

The apparatus of surface treatment may be applied to various types of objects of which surfaces need treating. For example, when the object is an artificial diamond, a pad conditioner may be manufactured using the artificial diamond of which a surface has been treated by the apparatus of surface treatment, and a CMP apparatus including the pad conditioner may be used in a planarization process for layers formed in, e.g., DRAM devices, flash memory devices, static random access memory (SRAM) devices, phase-change random access memory (PRAM) devices, magnetic random access memory (MRAM) devices, etc.

Although a few example embodiments have been described, those skilled in the art will readily appreciate that many modifications are possible in the example embodiments without materially departing from the novel teachings and advantages of the present inventive concept. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An apparatus for surface treatment of objects, the apparatus comprising:

a transfer part including a channel having first and second opposite end portions, the transfer part channel bent at a plurality of points between the first and second end portions;

an injection part at the first end portion of the transfer part channel, the injection part configured to inject an object into the transfer part channel;

an emission part at the second end portion of the transfer part channel, the emission part configured to emit the object from the transfer part channel;

a pressure supply part connected to the transfer part channel, the pressure supply part configured to supply pressure into the transfer part channel to move the object toward the emission part; and a collision part extending along at least a portion of the transfer part and defining a continuous collision surface such that a plurality of the bent points of the transfer part channel are exposed to the collision surface of the collision part such that the object moving in the transfer part channel collides with the collision surface of the collision part a plurality of times to treat a surface of the object, wherein the transfer part channel is exposed to the collision part at alternating ones of the plurality of bent points of the transfer part channel, wherein the transfer part channel has a diameter at bent points of the transfer part channel that are exposed to the collision part that is larger than a diameter at bent points of the transfer part channel that are not exposed to the collision part.

2. The apparatus of claim 1, wherein the transfer part is a substrate with the channel disposed therein.

3. The apparatus of claim 2, wherein the collision part is detachably mounted on the substrate.

4. The apparatus of claim 1, wherein the pressure supply part is configured to supply pressure by spraying gas or liquid into the transfer part channel.

5. The apparatus of claim 1, comprising a plurality of pressure supply parts, the pressure supply parts connected to the transfer part channel at spaced-apart portions thereof.

6. The apparatus of claim 1, wherein the object is an artificial diamond.

7. An apparatus for surface treatment of objects, the apparatus comprising:

a transfer part including a channel having first and second opposite end portions, the transfer part channel bent at a plurality of points between the first and second end portions;

an injection part at the first end portion of the transfer part channel, the injection part configured to inject an object into the transfer part channel;

an emission part at the second end portion of the transfer part channel, the emission part configured to emit the object from the transfer part channel;

a pressure supply part connected to the transfer part channel, the pressure supply part configured to supply pressure into the transfer part channel to move the object toward the emission part; and a collision part extending along at least a portion of the transfer part and defining a continuous collision surface such that a plurality of the bent points of the transfer part channel are exposed to the collision surface of the collision part such that the object moving in the transfer part channel collides with the collision surface of the collision part a plurality of times to treat a surface of the object, wherein the collision surface is a first collision surface, and wherein the collision part includes:

a first target extending along at least a portion of a first side of the transfer part and defining the first collision surface, wherein the transfer part channel is exposed to the first collision surface of the first target at alternating ones of the plurality of bent points of the transfer part channel such that the object moving in the transfer part channel collides with the first collision surface of the first target a plurality of times; and a second target extending along at least a portion of a second, opposite side of the transfer part and defining a second continuous collision surface, wherein the transfer part channel is exposed to the second collision surface of the second target at alternating ones of the plurality of bent points of the transfer part channel that are not exposed to the first collision surface of the first target such that the object moving in the transfer part channel collides with the second collision surface of the second target a plurality of times.

8. The apparatus of claim 4, wherein the pressure supply part is configured to supply air into the transfer part channel.

9. The apparatus of claim 4, wherein the pressure supply part is configured to supply water into the transfer part channel.

10. A method for surface treatment of objects, the method comprising:

providing an apparatus including:

an injection part;

an emission part;

a transfer part having a transfer channel extending between the injection part and the emission part, wherein the transfer channel is bent at a plurality of spaced-apart bent portions of the transfer channel;

a collision part on the transfer part and extending along at least a portion of the transfer part and defining a continuous collision surface such that a plurality of the bent portions of the transfer channel are exposed to the collision surface of the collision part; and a pressure supply part connected to the transfer channel;

injecting an object into the transfer channel via the injection part;

supplying pressure into the transfer channel via the pressure supply part;

conveying the object through the transfer channel using the supplied pressure such that the object collides with the collision surface of the collision part at the bent portions of the transfer channel that are exposed to the collision surface of the collision part to treat the object's surface; and emitting the object with the treated surface via the emission part, wherein the transfer channel is exposed to the collision surface of the collision part at alternating ones of the plurality of bent portions of the transfer channel, wherein the transfer channel has a diameter at bent portions of the transfer channel that are exposed to the collision surface of the collision part that is larger than a diameter at bent portions of the transfer channel that are not exposed to the collision surface of the collision part.

11. The method of claim 10, wherein the collision surface is a first collision surface, and wherein the collision part includes:

a first target extending along at least a portion of a first side of the transfer part and defining the first collision surface, wherein the transfer channel is exposed to the first collision surface of the first target at alternating ones of the plurality of bent portions of the transfer channel; and a second target extending along at least a portion of a second, opposite side of the transfer part and defining a second continuous collision surface, wherein the transfer channel is exposed to the second collision surface of the second target at alternating ones of the plurality of bent portions of the transfer channel that are not exposed to the first collision surface of the first target, wherein the method comprises conveying the object through the transfer channel using the supplied pressure such that:

the object collides with the first collision surface of the first target at the alternating ones of the plurality of bent portions of the transfer channel that are exposed to the first collision surface of the first target to treat the object's surface; and the object collides with the second collision surface of the second target at the alternating ones of the plurality of bent portions of the transfer channel that are not exposed to the first collision surface of the first target to treat the object's surface.

12. The method of claim 10, wherein the apparatus comprises a plurality of pressure supply parts, the pressure supply parts connected to the transfer channel at spaced-apart portions thereof.

13. The method of claim 10, wherein the transfer part is a substrate with the transfer channel disposed therein.

14. The method of claim 13, wherein the collision part is detachably mounted on the substrate.

* * * * *